US010777170B2

(12) United States Patent
Ognibeni

(10) Patent No.: US 10,777,170 B2
(45) Date of Patent: Sep. 15, 2020

(54) SOUND DIFFUSER ACCESSORY

(71) Applicant: ENRICO CIRESA S.r.l., Tesero (Trento) (IT)

(72) Inventor: Fabio Ognibeni, Pieve Tesino (IT)

(73) Assignee: ENRICO CIRESA S.R.L., Tesero (Trento) (IT)

( * ) Notice: Subject to any disclaimer, the term of this patent is extended or adjusted under 35 U.S.C. 154(b) by 0 days.

(21) Appl. No.: 16/322,627

(22) PCT Filed: Jul. 28, 2017

(86) PCT No.: PCT/IB2017/054616
§ 371 (c)(1),
(2) Date: Feb. 1, 2019

(87) PCT Pub. No.: WO2018/025138
PCT Pub. Date: Feb. 8, 2018

(65) Prior Publication Data

US 2020/0082799 A1 Mar. 12, 2020

(30) Foreign Application Priority Data

Aug. 3, 2016 (IT) ..... 102016000082006

(51) Int. Cl.
*G10C 3/06* (2006.01)
*G10K 13/00* (2006.01)

(52) U.S. Cl.
CPC ..... *G10C 3/06* (2013.01); *G10K 13/00* (2013.01)

(58) Field of Classification Search
CPC ..... G10C 3/06; G10K 13/00
See application file for complete search history.

(56) References Cited

U.S. PATENT DOCUMENTS 3,464,514 A 9/1969 Mochida et al.
2016/0071501 A1* 3/2016 Bousquet ..... G10K 1/07 84/402

FOREIGN PATENT DOCUMENTS

EP 1734786 12/2006
WO 97/09842 9/1997

OTHER PUBLICATIONS

International Search Report for PCT Application No. PCT/IB2017/054616 dated Oct. 23, 2017 (2 pages).

* cited by examiner

*Primary Examiner* — Kimberly R Lockett
(74) *Attorney, Agent, or Firm* — Tutunjian & Bitetto, P.C.

(57) ABSTRACT

Sound diffuser accessory, suitable to be associated to a sound source, such as an electric or electronic or digital musical device or instrument and suitable to diffuse sounds or sound signals deriving from said sound source, wherein such accessory includes at least one sound board, and support structure for the sound board, wherein the sound board includes a board or panel having a flat or slightly curved shape and including a first exposed surface, a second surface, opposite to the first surface and a thickness (S), wherein the sound board includes or is connected with at least one transducer of the electromechanical and/or piezoelectric and/or piezoceramic and/or magnetodynamic and/or magnetostrictive type and wherein the support structure includes at least one element having a substantially strip-like shape and spacer means having a height (H2), suitable to constrain and space the at least one sound board and the support structure.

26 Claims, 9 Drawing Sheets

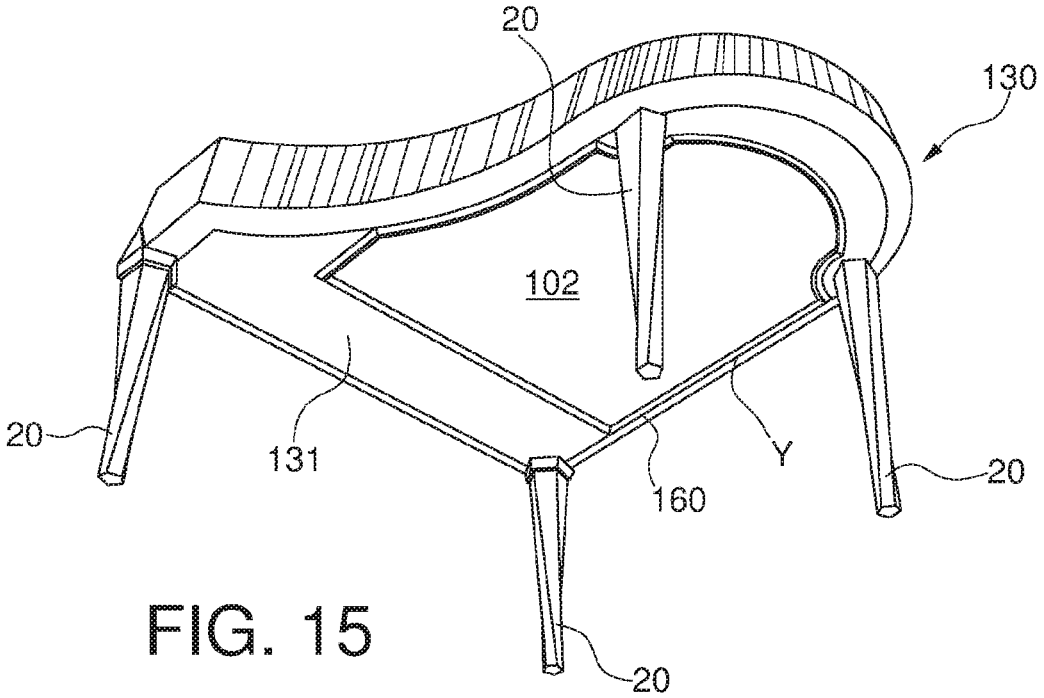
FIG. 15
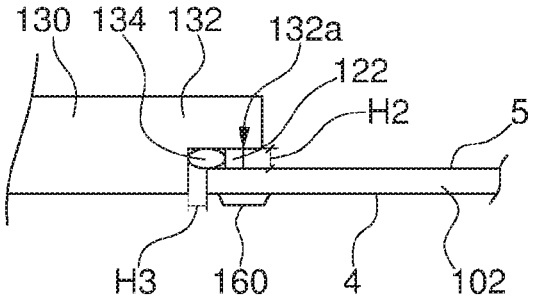
FIG. 16A
FIG. 16B
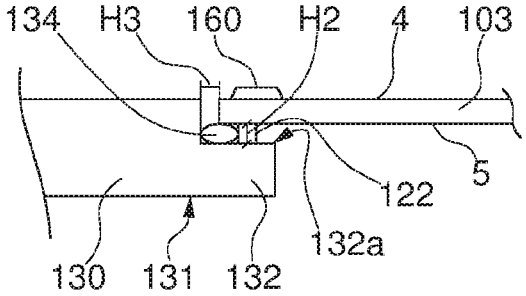

SOUND DIFFUSER ACCESSORY

TECHNICAL FIELD OF THE INVENTION

The present invention regards a sound diffuser accessory for environments, for example domestic environments, concert rooms, listening rooms, etcetera.

In particular, such accessory is capable of generating and diffusing sounds deriving from a sound source, such as for example an electric or electronic or digital musical device or instrument, so as to return a natural acoustic sound and in a wide range of frequencies.

STATE OF THE PRIOR ART

It is known that sound reproduction speakers are actuators that convert an electrical signal into sound waves. Thus, a speaker can be defined as an electro-acoustic transducer. Basically, the sound is generated by a series of air compressions and rarefactions and the speaker is the means that generates such compressions and rarefactions in the listening environment.

There are various types of speakers that apply different technologies. The most common are the magnetodynamic ones, in which a permanent magnet generates a magnetic field into which a moving coil is submerged, directly connected to the membrane of the speaker (still made of synthetic material, normally polyamide, and usually cone-shaped); an electrical signal, suitably amplified, which—thanks to the Lorentz Factor—moves the coil enabling the membrane to compress the surrounding air and thus produce a wave sound, is applied thereto.

Another type of speaker is that of piezoelectric type, which exploits piezoelectricity for converting the electrical signal into acoustic waves.

However, though striving to reach an increasingly lower dimension/power ratio so as to minimise the overall dimensions and, simultaneously, increase performance, speakers of the known type have the disadvantage of settling on specific and limited frequency ranges, for example low frequencies or high frequencies. Thus, in order to complete sound emission in a wide spectrum of frequencies transmitted by a speaker, there currently arises the need for combining devices with different characteristics, with ensuing increase of the overall dimensions and costs.

A further disadvantage of the speakers of the known type lies in that they transmit the sound in a limited and directive space, usually arranged at the front part of the speaker or at the base of the cone constituted by the membrane, when the latter is present.

Still, speakers of the known type, in particular speakers of the magnetodynamic type, are mounted in a closed or variously tuned box. For example, in such diffusers, there is present a sound box, at times divided into internal compartments, so as to prevent potential interference between the various speakers from having as effect that of creating a "dirty" sound, i.e. a reproduction not faithful to the originally transmitted sound, in which there are indeed interferences that disturb the sound or listening quality.

Thus, there arises the need to provide a diffuser accessory capable of receiving a sequence of sounds from a source and transmitting it in a natural manner, through a wide range of frequencies and also conferring "roundness" to the sound in the space, i.e. enabling to hear a high sound quality not only from the front side, but in the entire space surrounding the accessory.

Furthermore, there also arises a high need for providing a sound diffuser accessory whose shape is more efficiently capable of meeting design and aesthetic requirements, while still guaranteeing maximum sound diffusion quality.

SUMMARY OF THE INVENTION

The present invention has the objective of improving the state of the prior art. In this technical objective, an object of the present invention is to provide a sound diffuser accessory capable of transmitting high quality and high efficiency sounds, in a wide range of frequencies.

Another object of the present invention is to provide a sound diffuser accessory that is capable of transmitting the sounds not only from the front side but also on the entire space surrounding the accessory.

A further object of the present invention is to provide a sound diffuser accessory that is light in weight and, considering the same frequencies emitted, a simpler structure with respect to the structure of the diffusers of the known type, such as for example a conventional acoustic piano.

Still, another object of the present invention is to provide a sound diffuser accessory capable of meeting the various design and aesthetic needs.

In compliance with an aspect of the present invention there is provided for a sound diffuser accessory according to the present application.

The present application refers to preferred and advantageous embodiments of the invention.

BRIEF DESCRIPTION OF THE DRAWINGS

Further characteristics and advantages of the present invention shall be more apparent from the detailed description of a preferred but non-exclusive embodiment of a sound diffuser accessory, illustrated by way of non-limiting example in the attached drawings, wherein:

FIG. 15 is a perspective view from beneath of the sound diffuser accessory of FIGS. 11-14, FIGS. 16A and 16B are partial sectional views of a detail of the sound diffuser accessory of FIGS. 11-15.

DETAILED DESCRIPTION OF EMBODIMENTS OF THE INVENTION

Figure 1:
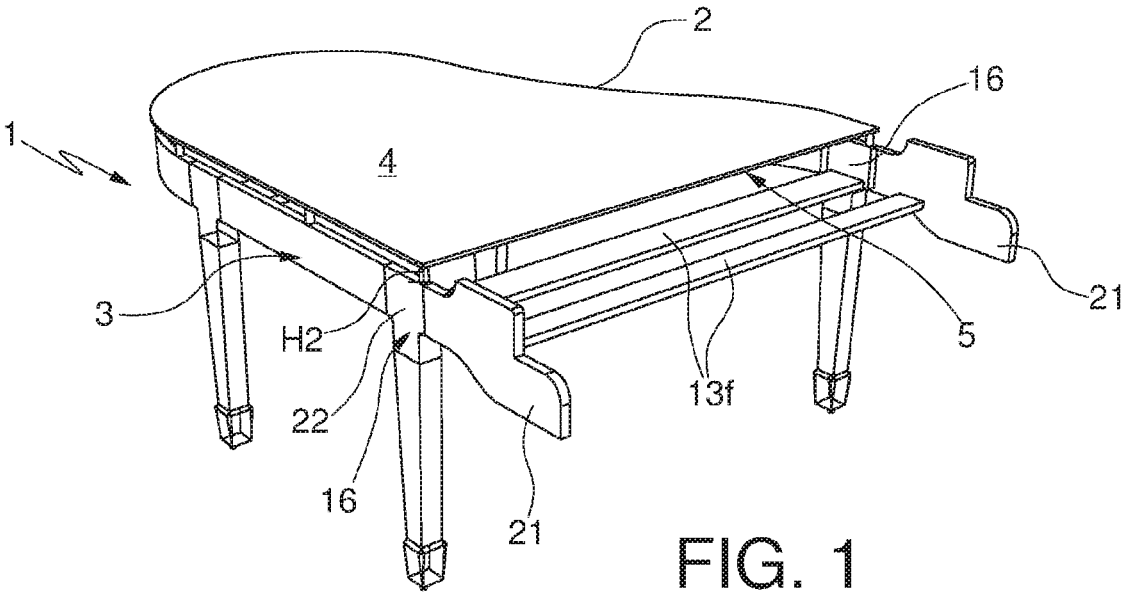
FIG. 1 is a partial front perspective view of a sound diffuser accessory according to the present invention.
Figure 2:
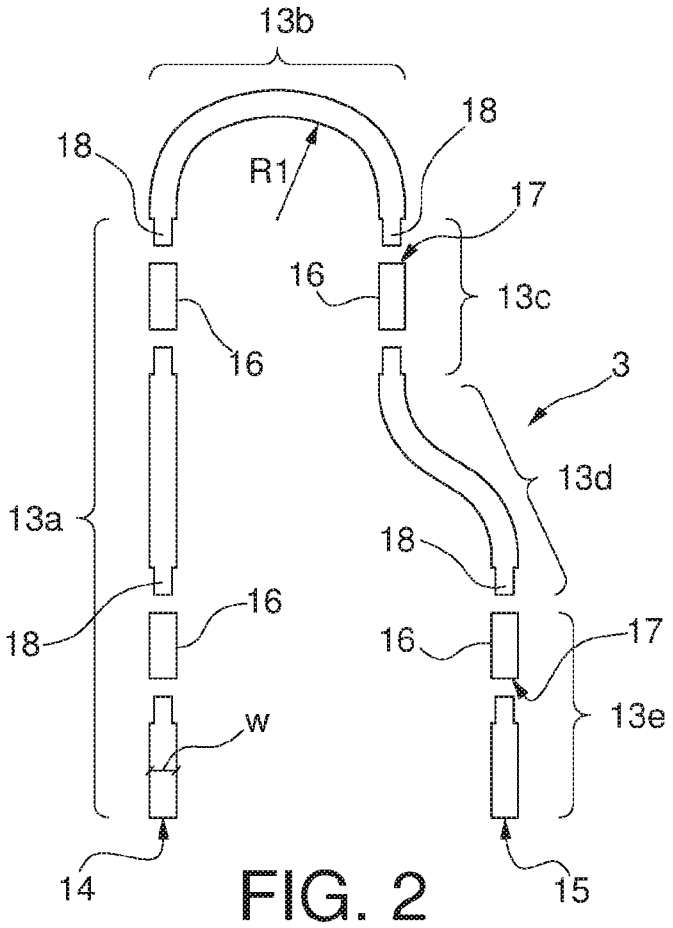
FIG. 2 is a plan schematic view of the support structure of the sound diffuser accessory according to the present invention.

The present invention refers to a sound diffuser accessory indicated in its entirety with 1 in the attached drawings.

The diffuser accessory 1 is capable of generating and/or diffusing sounds or sound signals.

This accessory comprises at least one sound board 2 and a support structure 3.

In a version of the invention, the sound diffuser accessory 1, illustrated by way of example in FIGS. 11-20, comprises a first sound board or upper sound board 103 and a second sound board or lower sound board 102, wherein the first sound board 103 is arranged in use above the second sound board 102, the latter being arranged in use beneath the first sound board 103.

The sound board 2 comprises a board or panel having a first exposed surface 4 and a second surface 5, opposite to the first exposed surface 4.

The sound board 2 has a flat or slightly curved shape.

The sound board 2 can be preferably made of wood, for example fir wood and/or a wood usually used for making music instruments. According to a version of the invention, such wood is obtained from Val di Fiemme fir trees.

Conventionally, the sound board 2 has the function of increasing the sonority of a music instrument provided with the afore-mentioned sound board, in that it is capable of amplifying and/or transducing the vibrations generated by a music instrument, creating sound waves.

According to the present invention, the diffuser accessory 1 serves its function through natural material, i.e. the sound board 2 for example made of wood, which serves as an acoustic membrane, and thus serving the same purpose as membranes of the speakers but made of a natural material and it has an extremely high sound transmission efficiency and quality.

The board or the panel that constitutes the sound board 2 comprises several slats or listels for example made of wood, which are assembled, for example by gluing, side-to-side up to reaching a width corresponding to the desired or predefined one depending on the design of the sound board 2.

According to a version of the present invention, such slats or listels, when made of wood, are arranged so as to align the wood fibres substantially according to a long side or long diagonal of the sound board 2. In a further version, such wood fibres are aligned along the larger side or larger diagonal of the sound board 2.

The sound board 2 has a thickness S. Such thickness S is variable.

Similarly, the slats that constitute the sound board 2 have a variable thickness S, in which S is comprised between 3.5 mm and 8.0 mm. The sound board 2, in a version of the invention, has a thickness of about 4-6 mm.

As a matter of fact, the sound board 2 does not have the same thickness S on the entire surface but variable thickness in different areas of the board. Such thickness differences are attained through a painstaking work of highly experienced personnel. For example, it can be said that the greater thickness S' is in the treble sounds or treble frequencies area (for example indicated with A in FIG. 10) while the thickness S degrades towards the bass sounds or bass frequencies area (for example indicated with B in FIG. 10), in which the minimum thickness S" is found.

Figure 10:
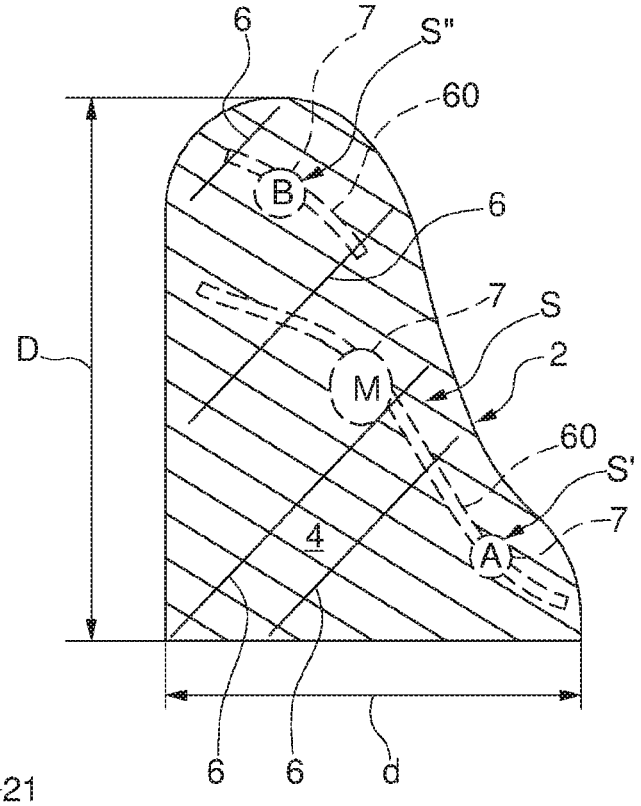
FIG. 10 is a plan schematic view of the sound diffuser accessory according to at least one version of the present invention.

Lastly, in the medium frequency area, indicated with M in FIG. 10, there is a thickness S intermediate between S' and S".

The areas or regions of the sound board 2 having a thickness S, S', S" different from each other have the effect of differentiating the elastic modulus in the various areas of the sound board 2 to facilitate better transfer of energy to the various frequencies from the sound board 2 to the air, to obtain a wide acoustic frequency band, as better specified hereinafter.

The sound board 2 further comprises at least one rib 6 (which has a schematic development with a dashed line in FIG. 10).

The at least one rib 6 is positioned, for example by gluing, at the second surface 5 of the sound board 2.

Such at least one rib 6 has the function of subjecting the sound board 2 to a mechanical and elastic tension. Such mechanical-elastic tension is constituted by a sort of curvature or load to which the sound board 2 is subjected so as to receive the vibrations that are transmitted to the sound board from a sound source through the transducers.

Furthermore, the at least one rib 6, serves to convey the energy to the entire sound board 2 in the least time possible, so as to maximise and balance the quality and quantity of the produced sound waves.

The at least one rib 6 is arranged in a substantially transversal or inclined manner with respect to the direction of the wood fibres of the slats or listels that form the sound board or in a substantially transversal or inclined manner with respect to the long side or larger side or to a long diagonal or to a larger diagonal of the sound board 2. In this way, this enables obtaining a uniform diffusion and/or transmission of the vibrations over the entire sound board 2.

In a version of the invention, the at least one rib 6 comprises a wood listel, possibly made from a fir tree.

The at least one rib 6 may have a straight or curvilinear or slightly curvilinear development or shape. This aspect may be established from case to case, depending on the tension or load to be applied to the sound board 2 and/or the acoustic design (acoustic characterisation). In a version of the invention, the sound board 2 comprises at least two ribs 6 or several ribs 6, depending on the dimensions of the board.

In a version of the invention, the sound board 2 comprises six to nine ribs 6; the at least one rib 6 may have a greater thickness with respect to that of the sound board 2. The at least one rib 6 may have a length comprised between 1600 mm and 300 mm approximately, with thicknesses comprised between 13 mm and 26 mm and a height comprised between 10 mm and 30 mm.

The height of the rib 6 is intended as the downward projection of the rib 6 from the second surface 5 of the sound board 2 while the thickness of the rib corresponds to the portion or face of the rib 6 at contact or glued on the second surface 5 of the sound board 2.

The radius of curvature of the at least one rib 6, when the latter has a curvilinear development, is such to confer the sound board 2 a load between 1 mm and 12 mm, in terms of transversal roundness.

According to a further version of the invention, the sound board 2 may have one or more recesses or seats 7 provided in the second surface 5 of the sound board 2.

Such recesses or seats 7 serve as a housing for at least one transducer, as better clarified hereinafter.

There may be possibly present further openings (not illustrated) provided on the sound board 2 or on the second surface 5, passing through or blind, which may confer further timbre details to the sound board.

As previously mentioned, the sound diffuser accessory 1 according to the present invention further comprises a support structure 3. Such structure serves as a support and sustaining element for the sound board 2.

In particular, the support structure 3 serves as a suspended or raised or elevated support for the sound board 2 with respect to the structure.

In a version of the invention, the support structure 3 is constituted by an element having a substantially strip-like shape 13 or by at least one element having a substantially strip-like shape 13.

Such element having a substantially strip-like shape 13 may have an annular or open annular development.

The support structure 3 has a shape and development such to substantially correspond to at least part of the perimeter edge of the sound board 2.

For example, according to a version, the support structure 3 and/or the element having a substantially strip-like shape 13 is constituted by a single listel shaped in a manner corresponding to the perimeter edge of the sound board 2.

The support structure 3 departs from the plane on which the sound board 2 lies with a development substantially perpendicular to the latter.

In a further version of the invention, the support structure 3 and/or the element having a substantially strip-like shape 13 is constituted by one or more variously shaped parts or components.

The support structure 3 and/or the element having a substantially strip-like shape 13 can be made of wood, for example made of the same wood as the wood that the sound board 2 may be made of or a different wood, even not of the resonant type, or made of a plastic material or made of a material capable of supporting the sound board itself. The plastic material may be a synthetic or artificial plastic material.

In a version of the invention, wherein the support structure 3 and sound board 2 have a substantially grand piano-like plan configuration (except for the keyboard area and obviously excluding the entirety of the strings and mechanism related to the operation of the piano itself), the support structure 3 and/or element having a substantially strip-like shape 13 has a first section 13*a* with substantially straight development, a second section 13*b* with substantially curved development with a first radius of curvature R1, a third section 13*c* with substantially straight development, a fourth section 13*d* with substantially S-shaped development and lastly a fifth substantially straight section 13*e*.

The second section 13*b* has a substantially semi-circular configuration. The concavity of the second section 13*b* is faced towards the centre of the area that is subtended to the support structure 3 or the space ideally enclosed by it.

In a version of the invention, the support structure 3 and/or the element having a substantially strip-like shape 13 has a first section 13*a* with substantially straight development, a second section 13*b* with substantially curved development with a first radius of curvature R1, a third section 13*c* with substantially curved development with concavity substantially opposite to that of the second section 13*b*, and lastly a further substantially straight section 13*e*.

In a further version of the invention, the sections 13*b*, 13*d*, and possibly 13*c* are mutually shaped so as to form a sort of overturned S.

The first section 13*a* has a first end 14, opposite to the second end of the first section 13*a*, the latter end being connected or constrained to the second section 13*b*.

The third section 13*c* with substantially straight development, when present, has a development that departs from the second section 13*b* and extends in the substantially parallel direction towards the first end 14 of the first section 13*a*.

The fourth substantially S-shaped section 13*d*, when present, is arranged moving apart with respect to the first section 13*a*.

The third section 13*c* with substantially curved development is arranged moving apart with respect to the first section 13*a* too.

The fifth or further section 13*e* has a first end 15, opposite to the second end of the fifth section 13*e*, the latter end being connected or constrained to the fourth section 13*d* and/or to the section 13*c*.

The first end 14 of the first section 13*a* and the first end 15 of the fifth or further section 13*e* are aligned, possibly along the same line or positioned on the same plane.

In a version of the invention, the support structure 3 and/or the element having a substantially strip-like shape 13 may have a sixth section 13*f* (or connection section, for example observable in FIG. 1), with substantially straight development and perpendicular to the first section 13*a* and the fifth or further section 13*e*.

In at least one version of the invention, the support structure 3 and/or the element with substantially strip-like development 13 may have only some of the previous sections, without departing from the scope of protection of the present invention.

In a version of the invention, the low frequency area B is in the area of the sound board 2 substantially subtended to the second section 13*b* or proximal to the second section 13*b* or to the joining section 13*g* (as outlined in detail hereinafter).

The high frequency area A is instead positioned substantially at the fourth section 13*d* with an S-shaped development or, in the versions illustrated in FIGS. 8 and 9, substantially proximal to the third section 13*c* (as outlined in detail hereinafter).

The medium frequency area M is intermediate between the low frequency area B and the high frequency area A.

When present, the sixth section or connection section 13*f*, alongside at least some of the previously described sections 13*a*-13*e*, 13*g*, determines a closed annular structure for the support structure 3 and/or for the element having a substantially strip-like shape 13.

In a version of the invention, the first section 13*a* corresponds to the long side of the sound board 2.

In a further version, the third section 13*c*, possibly combined with the fourth section 13*d* and the fifth section 13*e*, corresponds to the long side or to the larger side of the sound board 2.

Further connection sections 13*f*, associated or positioned in further points of the support structure 3, so as to reinforce it, may be present.

The support structure 3 and/or the element having a substantially strip-like shape 13 are made up of one or more parts or components having a configuration to form a parallelepiped with rectangular base. In such configuration, the faces 13*h* thereof having larger surface are positioned in a manner substantially perpendicular to the sound board 2.

Similarly, the faces 13*h* of the support structure 3 and/or of the element having a substantially strip-like shape 13 having a larger surface are positioned in a manner substantially perpendicular to the sound board 2.

Such parallelepipeds and/or such support structure 3 and/or such element having a substantially strip-like shape 13 have a thickness W, substantially equal (in at least one version of the invention) over the entire extension of the support structure 3 and/or the element having a substantially strip-like shape 13.

The element having a substantially strip-like shape 13 and/or the support structure 3 comprise in use an upper edge 132*a*, the edge 132*a* facing or being arranged facing towards the surface 5 of the sound board 2.

The faces 13*h* have a height H1.

When present, the various components of the support structure 3 can be mutually assembled so as to form the support structure itself upon assembly.

In a version of the invention, the support structure 3 further comprises connection means 16.

Such connection means 16 are suitable to connect the various components of the support structure 3 and/or of the element having a substantially strip-like shape 13, when the latter are not made of a single piece.

Furthermore, the connection means 16 can also be suitable to connect the support structure 3 and the sound board 2 (through spacer means 22).

According to an embodiment, such connection means are all identical to each other and/or can be variously positioned in any point of the support structure 3, so as to facilitate the mounting of the accessory according to the present invention and make the various components interchangeable.

Figure 6:
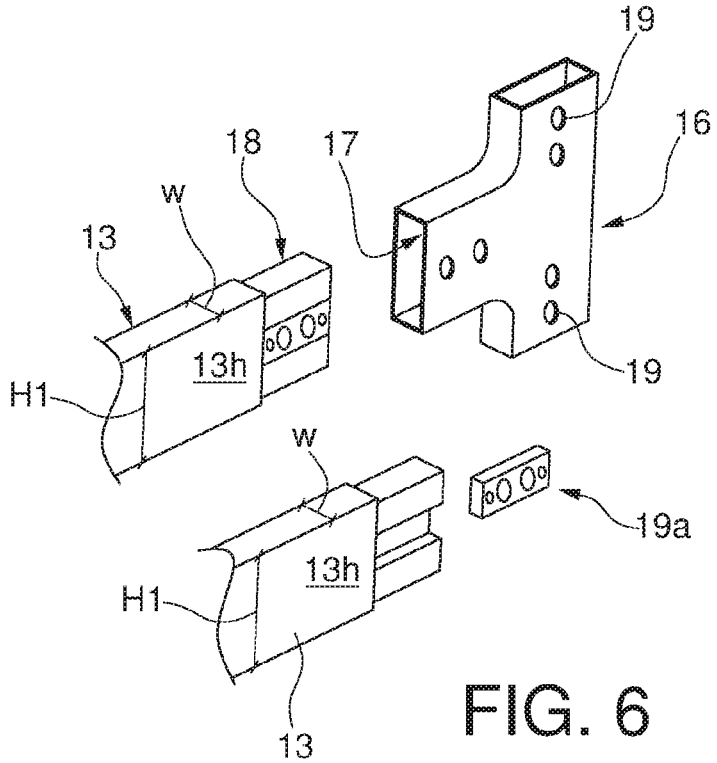
FIG. 6 is a schematic and perspective view of a detail of a version of the sound diffuser accessory according to the present invention.

Still, according to an embodiment, illustrated in FIG. 6, the connection means 16 comprise a central body provided with at least one seat 17.

Such at least one seat 17 constitutes a housing for an end 18 of at least one component of the support structure 3 and/or of the element having a substantially strip-like shape 13.

In particular, the end 18 has a configuration substantially corresponding to that of the seat 17, so as to be inserted into the seat 17 itself and thus be at least partly housed therein.

The connection and fixing between connection means 16 and support structure 3 and/or element having a substantially strip-like shape 13 can be made more secure for example by inserting special pins or screws or metal fasteners 19.

In this case, the end 18 may have at least one element and/or a relative seat 19*a* capable of facilitating the insertion and fixing of the pins or screws or metal fasteners 19.

Figure 5:
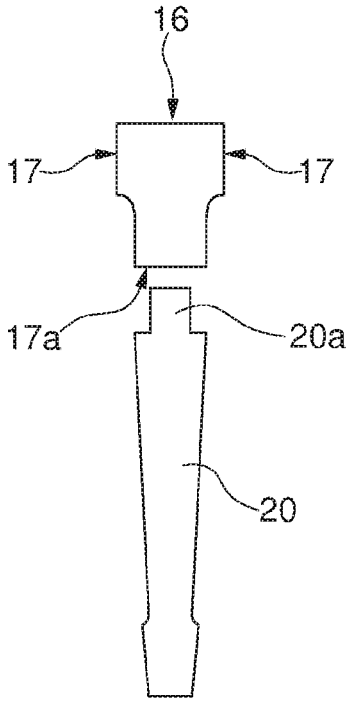
FIG. 5 is a schematic front view of a component of the support structure of the sound diffuser accessory according to the present invention.
Figure 7:
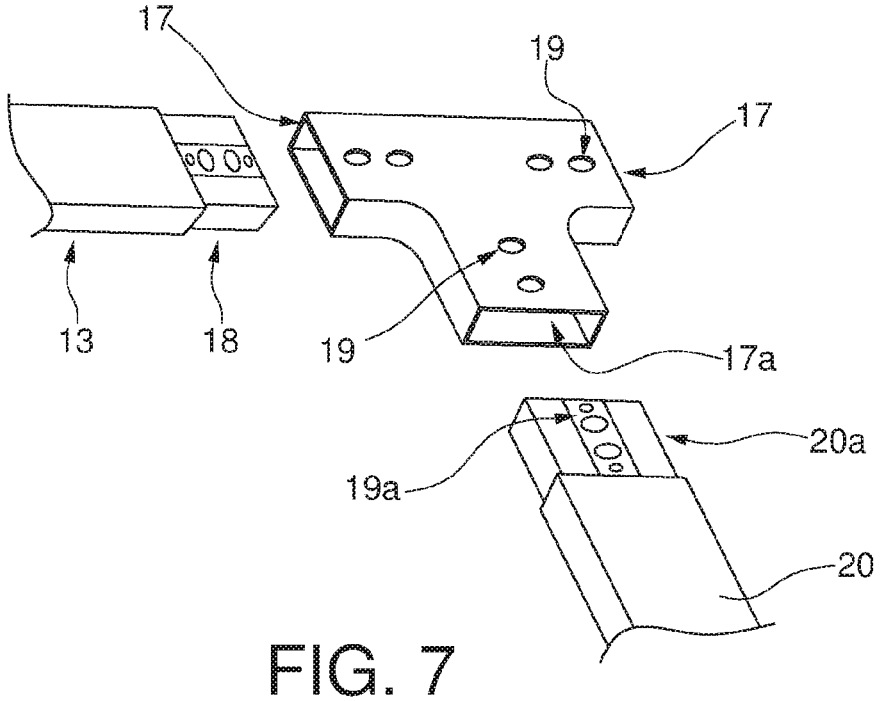
FIG. 7 is a schematic and perspective view of a detail of a further version of the sound diffuser accessory according to the present invention.

According to a version of the invention, for example illustrated in FIG. 5 or 7, the connection means 16 comprise a central body provided with two seats 17, positioned at opposite side. Such seats 17 have a development receding into the central body, possibly parallel to the plane on which the sound board 2 lies. However, being suitable to house the ends 18 of the support structure 3 and/or of the element having a substantially strip-like shape 13, such seats 17 have their larger surfaces arranged perpendicularly to the sound board 2.

The accessory 1 or the support structure 3 can possibly comprise at least one support leg or bracket 20. Such support leg or bracket 20 may be more than two in number, so as to enable the support structure 3 and the sound board 2 to be raised from the ground by a given height.

Such at least one support leg or bracket 20 has an end 20*a*, entirely similar in at least one version of the invention, to the end 18 of the support structure 3 and/or of the element having a substantially strip-like shape 13, suitable to be housed in a further or third seat 17*a* present in connection means 16. Also the seat 17*a* may have substantially the same configuration as the at least one seat 17 and be possibly further fixed through pins or screws or metal fasteners 19.

In a version of the invention, the third seat 17*a* may substantially have the same configuration as the seat 17 but different in dimension. Similarly, the end 20*a* of the support leg or bracket 20 may substantially have the same configuration as the end 18 but different in dimension.

For example, the seat 17 may have a gap or opening with dimensions substantially corresponding or slightly greater than the height H1 of the face 13*h* of the support structure 3 and/or of the substantially strip-like element 13; the seat 17*a* may have a gap or opening with dimensions smaller than H1, for example corresponding to the width of the end 20*a* of the support leg or bracket 20.

For example, H1 can be about 12-14 cm while the support leg or bracket 20 and/or the end 20*a* thereof has a width of about 9 cm.

The thickness of the support leg or bracket 20 and/or of the end thereof 20*a* and the thickness W of the strip-like element 13 and/or of the support structure 3 can be the same. Similarly, the end 20*a* of the leg 20 may have at least one element and/or a relative seat 19*a* capable of facilitating the insertion and fixing of the pins or screws or metal fasteners 19.

In a version of the invention, the support leg or bracket 20 may comprise an end 20*a* suitable to be directly connected to the support structure 3, 130 or to a base thereof, as better described hereinafter.

The connection means 16 and/or the seats 17, 17*a* thereof, are suitable to be engaged with the support structure 3 or with the components or parts thereof, so as to assemble the support structure 3 and support the sound board 2.

According to a possible version, the connection means are T-shaped and each section of the T has a seat 17 and/or a seat 17*a*.

Thus, the connection means are symmetrical at least along a symmetry plane (for example passing through the section perpendicular to the others of the T) and interchangeable at will, so that they can be used in any position along the support structure 3 and/or the substantially strip-like element 13.

In particular, the end 17*a* opens at the base of the section of the T perpendicular to the other two sections, at least in a version of the invention. Thus, the two ends 17 are aligned along the direction in which the substantially strip-like element 13 develops and/or along the edge of the sound board 2.

Given that it can be coupled to digital and/or electronic pianos, the at least one support leg or bracket 20 may have a height equivalent to the height that piano legs usually have, in a manner such that the accessory can be perfectly coupled with the digital and/or electronic piano.

Figure 4:
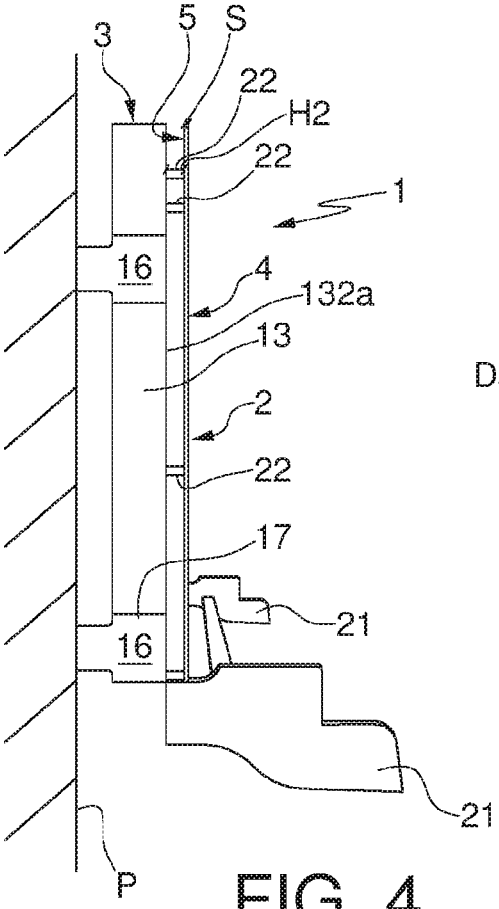
FIG. 4 is a lateral perspective view of a further version of the sound diffuser accessory of FIG. 1.

In the version illustrated in FIG. 4, the accessory 1 according to the present invention can be fixed to a wall P, instead of being placed on the ground. In such version, damping means (not illustrated) can be provided for absorbing vibrations and preventing the transmission thereof from and towards the sound board 2.

The damping means may comprise wall-fixed brackets or fasteners.

In this case, a section of the T or a portion of the connection means 16 serves as a spacer between the wall and the support structure 3.

In at least one version of the invention, so as to facilitate possible transportation of the accessory 1 (besides the advantage of the same to be lighter with respect to conventional music instruments and/or known speakers), the support structure 3 thereof is entirely disassemblable.

The connection means 16, between the various components or parts of the support structure 3, can be interchangeable so as to facilitate assembly and/or disassembly as much as possible, even without requiring specialised personnel (as it for example occurs when there is the need of assembling or transporting a grand piano).

Interchangeable means that they can be used directing them variously, depending on the need, and/or that they can be used for connecting such various components or parts of the support structure 3 without a pre-established order. For example, one same connection means 16 may connect the first section 13*a* of the structure 3 with the second section 13*b*, or still the second section 13*b* with the third section 13*c*, and so on and so forth, without position restrictions for the connection means 16.

The connection means 16 can be made of wood or made of plastic material or made of a material comprising carbon fibre or made of metal material such as for example steel, stainless steel, etcetera, or any material that is resistant and capable of enabling connection with the support structure 3.

The connection means 16 are for example removable connection and fixing means. FIGS. 11-20 illustrate a further embodiment of the present invention. This version comprises elements corresponding to those of the embodiment described above and, unless otherwise explicitly indicated, characteristics and functionalities described above can be deemed valid even for this further embodiment.

This embodiment regards a sound diffuser accessory indicated in its entirety with 100 capable of generating and/or diffusing sounds or sound signals, comprising at least one sound board 102, 103 and a support structure 130.

In particular, the sound diffuser accessory 100, comprises—as mentioned above—a lower sound board 102 and an upper sound board 103.

Each sound board 102, 103 comprises a first outer or exposed surface 4 and a second surface 5, opposite to the first surface 4, and respectively facing towards the other sound board.

In particular as regards the upper sound board 103, it has a variable thickness S in the various areas of the board. For example, there is present a greater thickness in the treble sounds or treble frequencies area (for example indicated with A in FIG. 19), the thickness S degrades towards the bass or bass frequencies area (for example indicated with B in the FIGS. 18-20), in which the minimum thickness S" is found.

Figure 19:
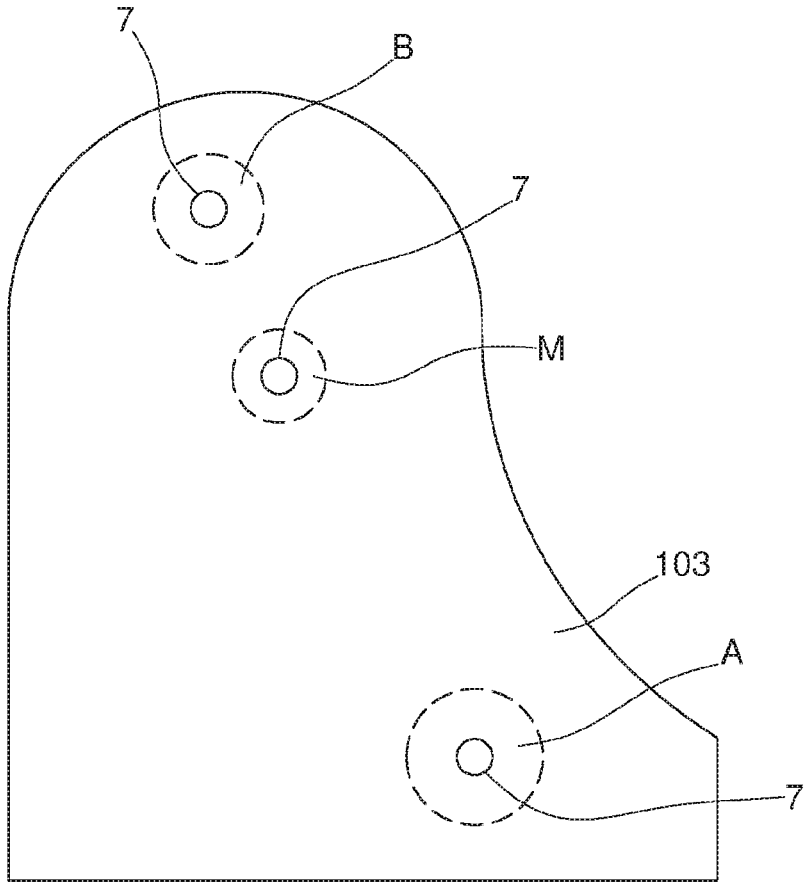
FIG. 19 is a plan schematic view of an upper component of the sound diffuser accessory of FIGS. 11-13 and 17.

Lastly, in the medium frequency area, indicated with M in FIG. 19, there is a thickness S intermediate between S' and S".

In a version of the invention, the sound board 102 may instead have only one area with thickness S", corresponding to the bass sounds or bass frequencies area B. Thus, in this case, the lower sound board 102 could have a thickness S" constant over the entire width, according to a version of the invention.

The sound boards 102, 103 also have each at least one rib, as indicated concerning the previous embodiment.

As indicated regarding the previous embodiment, each sound board 102, 103 may have one or more recesses or seats 7 arranged in the second surface 5 thereof, for housing at least one transducer T.

The support structure 130 serves as a support and/or sustaining element for the at least one sound board 102, 103 and it comprises at least one element having a substantially strip-like shape 113, having an annular or open annular development.

According to a version, the element having a substantially strip-like shape 113 is constituted by a single listel shaped in a manner substantially corresponding to the perimeter edge of the sound board 102, 103.

In at least one version of the invention, the element having a substantially strip-like shape 113 is inclined, in at least one portion thereof or at least in the outer side thereof, with respect to the plane on which the sound board 102 lies (the sound boards 102, 103 lie on two substantially parallel planes and they are substantially superimposed on each other).

Figure 12:
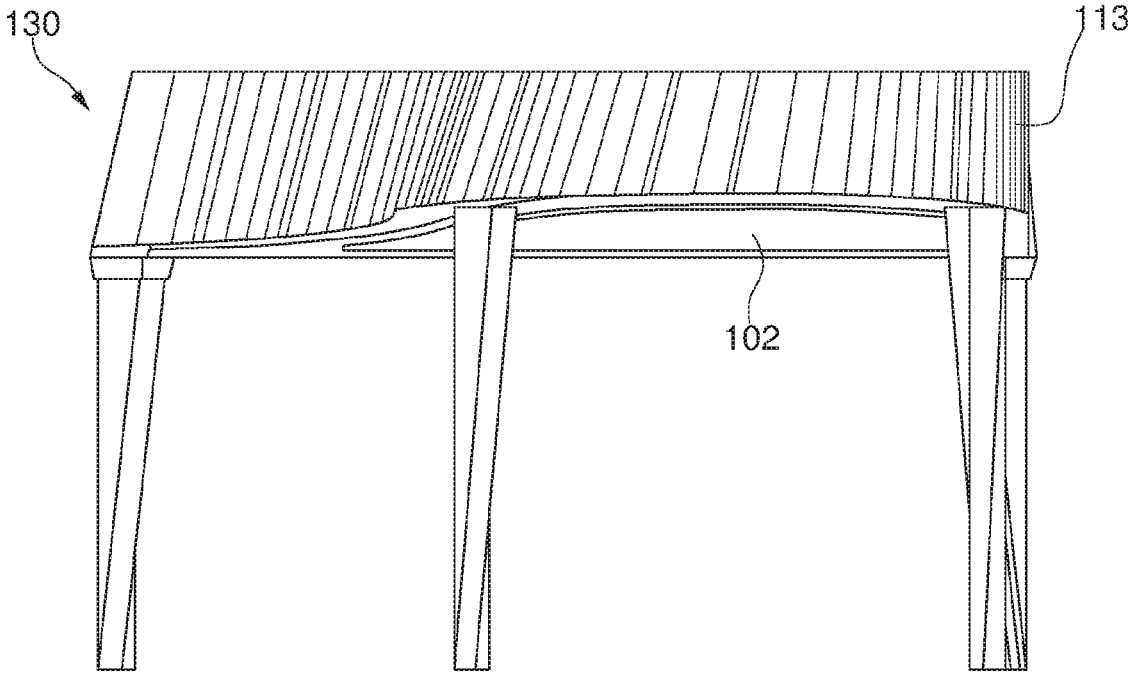
FIG. 12 is a rear view of the sound diffuser accessory of FIG. 11.
Figure 13:
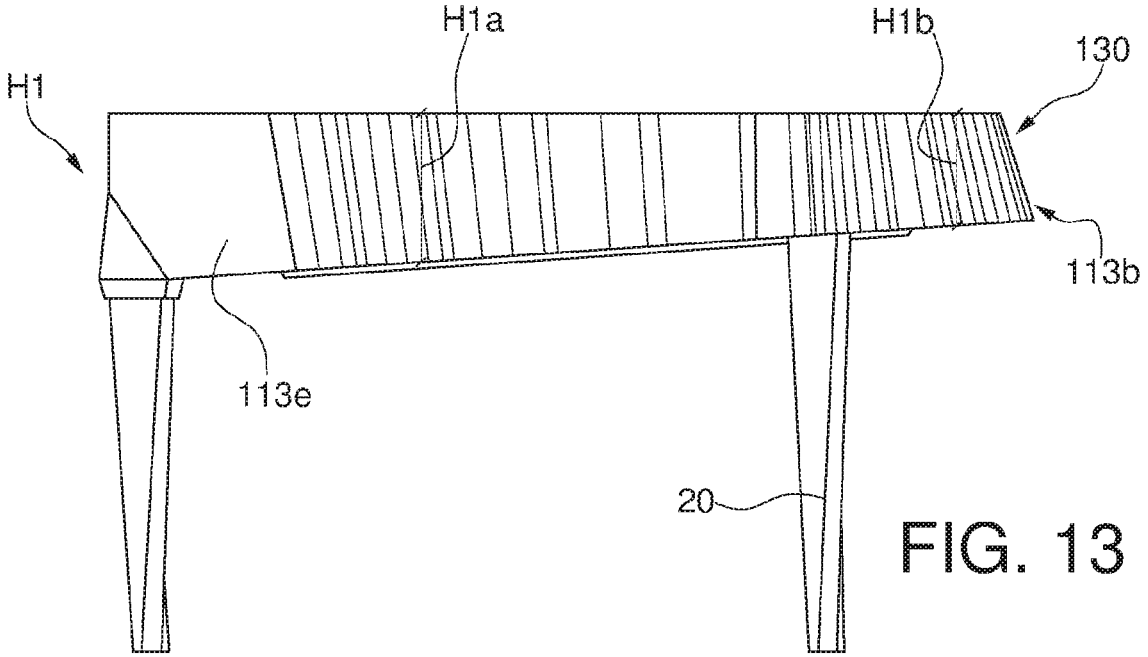
FIG. 13 is a lateral view of the sound diffuser accessory of FIGS. 11 and 12.
Figure 14:
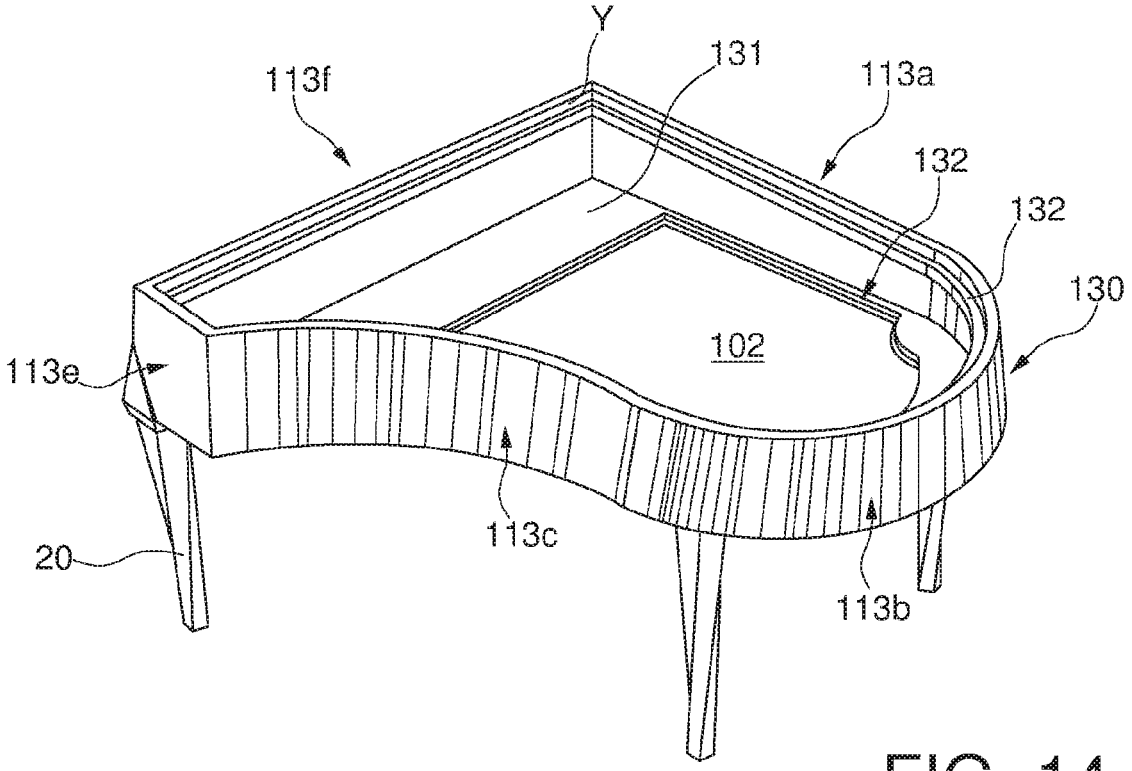
FIG. 14 is a perspective view from above and partly assembled of the sound diffuser accessory of FIG. 11.

As observable in FIGS. 12-14, the element 113 may have (at least externally) a variable inclination angle with respect to the plane on which the sound board 102 lies, for example an acute inclination angle at the rear part of the accessory 100 and an inclination angle proximal to 90° for example at least one side of the accessory itself (considering the rear part of the accessory 100 the one most proximal to the bass sounds or bass frequencies area B).

In at least one version, the element 113 may internally have a development substantially perpendicular to the plane on which the lower sound board 102 lies, for example along the entire extension thereof.

The element having a substantially strip-like development 113 may have, additionally or alternatively to the further versions thereof, in particular with respect to what has been just described above, a different height at the part thereof proximal to the front part of the accessory 100 with respect to the rear part thereof.

For example, as illustrated in FIG. 13, the element having a substantially strip-like shape 113 has a greater height H1*a* at the front part of the accessory 100 and a height H1*b*, smaller than H1*a*, at the rear part thereof.

According to a further version of the invention, the element 113 may have (both internally and externally) a development substantially perpendicular to the plane on which the sound board 102 lies along the entire perimeter of the latter.

Figure 17:
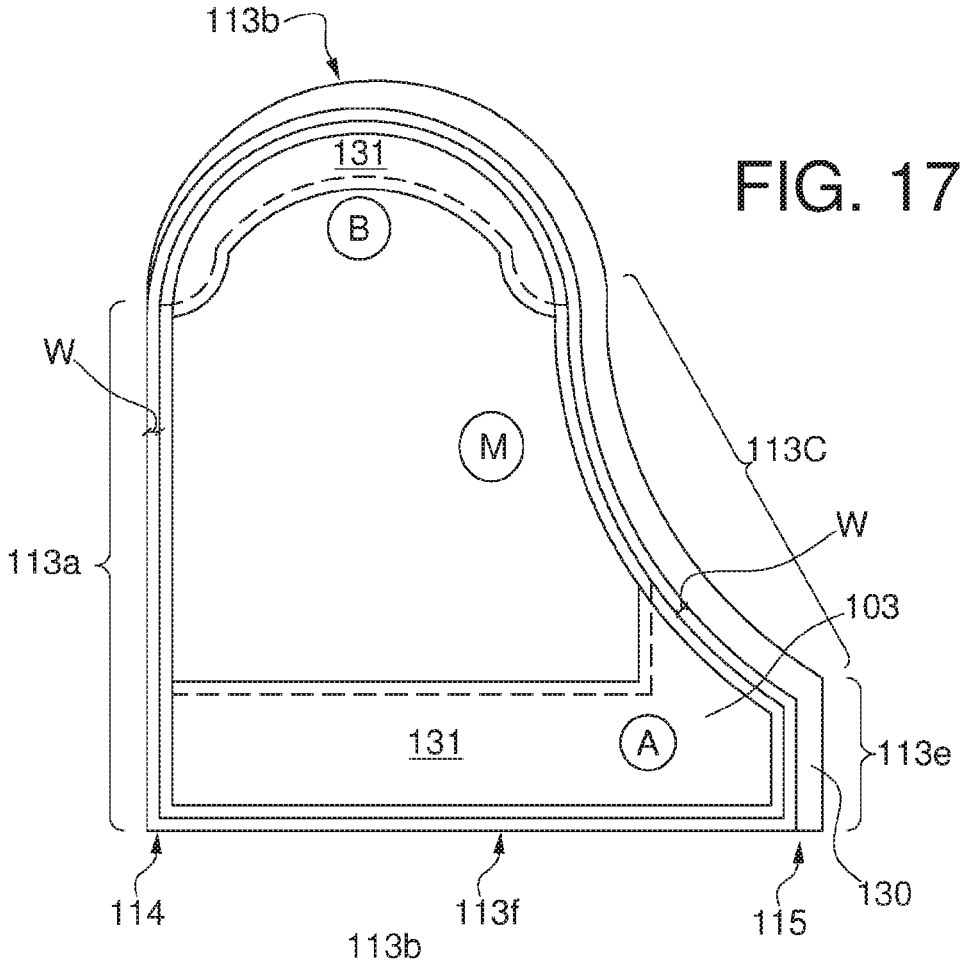
FIG. 17 is a plan schematic view of the sound diffuser accessory of FIG. 11.

In a further version of the present invention, the sections of the element having a substantially strip-like shape 113 arranged at a right angle with respect to each other (i.e. a side and a front portion, possibly at the sections 113*a* and 113*f*, indicated in FIG. 17), have a constant thickness and/or have a development substantially perpendicular to the plane on which the sound board 102 lies.

As observable in the attached figures, solely by way of example, the upper sound board 103 has greater dimensions with respect to the dimensions of the sound board 102. Thus, in at least one version of the invention, the support structure 130 may comprise a base 131, as observable in FIGS. 14-16. Such base 131, alongside the sound board 102, may close at the lower part the lower surface enclosed by the element 113.

Such base 131 has a surface extension substantially corresponding to that of the sound board 103 and/or corresponding to the area subtended by the lower edge of the element having a substantially strip-like shape 113 and it has a hole having a shape substantially corresponding to that of the sound board 102 and suitable to house and/or support the latter. The structure 130 comprises, as observable in detail in FIGS. 16A and 16B, at least one step 132.

The at least one step 132 comprises or it is a sort of protrusion that departs from the inner wall of the element having a substantially strip-like shape 113. Thus, the step 132 projects towards the inner part of the structure 130, in a manner substantially coplanar with the sound board 102, 103.

The at least one step 132 serves as a support and/or sustaining element for each sound board 102, 103.

In particular, the edge 132*a*, faced towards the surface 5 of the sound board 102, 103 is determined in this version by the at least one step 132.

Still getting further in detail, the second sound board 102, as observable in FIG. 16A is supported by a second step 132, through spacer means 122.

The edge 132*a* in particular constitutes the lower face of the second step 132, to which at least one spacer means 122 is connected through a first end. To the second end of the spacer means 122 there is connected the lower sound board 102, which is thus suspended and arranged lower than the first step 132 and the spacer means 122.

The sound board is positioned in a manner such that it is spaced both with respect to the first step 132 (vertically staggered by a section H2) and the support structure 130 (laterally spaced by a section H3), so as to enable the sound board 102 to vibrate freely and thus serve its purpose.

A gasket 134 is positioned at the angle arranged between the second step 132 and the support structure 130, at contact with the spacer means 122 and/or with the surface 5 of the sound board 102.

Such gasket 134 serves, for example, to block the compression of the compressed air volume between the two sound boards 102, 103 (i.e. that air volume inside the structure 130 of the accessory 100) and/or prevent the creation of "beat" noises or interference between the components/materials that form the accessory 100 (i.e. for example the support structure, the sound boards, the edges thereof, etc.).

Similarly to the description outlined above, but in a mirror-like fashion, the sound board 103, as observable in FIG. 16B is supported by a first step 132, through spacer means 122.

In particular, the edge 132*a* constitutes the upper face of the first step 132, to which at least one spacer means 122 is connected through a first end. To the second end of the spacer means 122 there is connected the upper sound board 103, which is thus found at a raised position with respect to the first step 132 and the spacer means 122.

Even in this case, the sound board is positioned in a manner such that it is spaced both with respect to the first step 132 (vertically staggered by a section H2) and the support structure 130 (laterally spaced by a section H3), so as to enable the sound board 103 to vibrate freely and thus serve its purpose.

The first step 132 is positioned at the in use upper inner wall of the element having a substantially strip-like shape 113 while the second step 132 is positioned at the in use lower inner wall of the element having a substantially strip-like shape 113.

A gasket 134 is positioned at the angle arranged between the first step 132 and the support structure 130, at contact with the spacer means 122 and/or with the surface 5 of the sound board 103.

In at least one version of the invention, the gasket 134 has a development substantially corresponding to that of the at least one sound board 102, 103.

The sound boards 102, 103 are thus recessed into the support structure 130, almost forming for the accessory 100 a box-shaped element or a furnishing component or a piece of furniture. However, they remain suspended or raised and/or elevated with respect to the support structure 3, 130 and/or the edge 132*a* of the support structure 3, 130.

In at least one version of the invention, the element having a substantially strip-like development 113 projects, at the upper part and/or at the lower part with respect to the upper 103 and/or lower 102 sound board respectively by a given section Y.

Such section Y has, for example, a size comprised between 1 cm and 10 cm or between 2 cm and 6 cm or even more preferably 3 or 4 cm.

The section Y helps avoiding acoustic problems during the operation of the accessory 100.

The presence of the lower sound board 102 for example helps increasing the quality and/or the intensity of the bass sounds or bass frequencies, in that it has a transducer in the respective area B.

Figure 20:
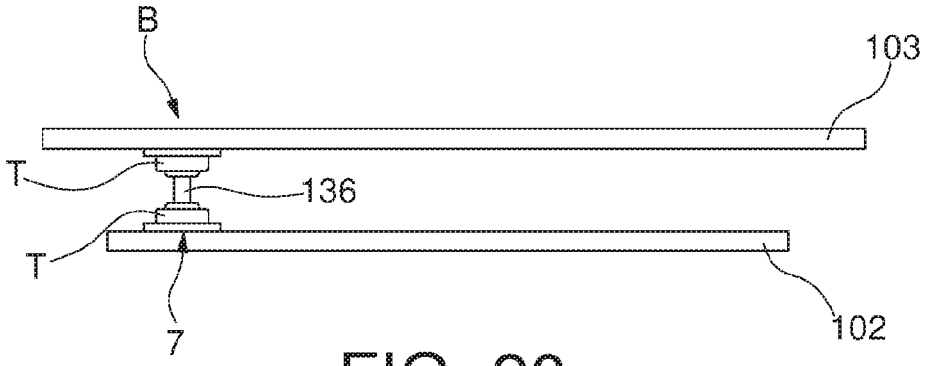
FIG. 20 is a partly sectional schematic view of the sound diffuser accessory of FIG. 11.

As observable in FIG. 20, the lower sound board 102 and the upper sound board 103 are mechanically connected by a connector element 136. Such connector element 136 connects, for example the bass transducers respectively positioned on the surface 5 of the sound boards 102, 103.

The connector element 136 is positioned at the rear part of the accessory 100.

Such connector element 136 (possibly made of wood) may be shaped to form a pin or a cylinder or a parallelepiped or any other suitable shape. Thanks to the presence thereof, the sound boards 102, 103 vibrate together considerably improving the quality of the sound transmission and/or emission thereof.

At the support structure 130 (preferably at the sections 13*a* and/or 13*f*) there can be provided for compartments for access to the space enclosed between the two sound boards 102, 103 so as to facilitate the assembly thereof and/or connection with the other elements of the accessory 100 and/or compartments for possibly inserting any displays or front elements for the connection of the other elements of the accessory 100.

In a further version of the invention, the support structure 130 and/or the element having a substantially strip-like shape 113 is constituted by one or more variously shaped parts or components.

In a version, in which the support structure 130 and/or the element having a substantially strip-like shape 113 and/or the upper sound board 103 (as observable in FIG. 17) have substantially a grand piano plan configuration, they have a first section 113*a* with substantially straight development, a second section 113*b* with substantially curved development with a first radius of curvature R1, a third section 113*c* with substantially curved development with a second radius of curvature R2 and lastly a further substantially straight section 13*e*.

The second section 113*b* has a substantially semi-circular configuration, whose concavity is faced towards the centre of the area that is subtended to the support structure 130 or the space ideally enclosed by it.

The third section 113*c* has a substantially semi-circular configuration, whose convexity is faced towards the centre of the area that is subtended to the support structure 130 or the space ideally enclosed by it.

The first section 113*a* has a first end 114 and a second end, opposite to the first end 114, such second end being connected or constrained to the second section 113*b*.

The third section 113*c* has a development that departs from the second section 113*b* and extends outwards moving apart with respect to the first section 113*a*.

The further section 113*e* has a first end 115 and a second end, opposite to the first end 115, such second end being connected or constrained to the third section 113*c*.

The further section 113*e* is substantially parallel to the first section 113*a* and the first end 114 of the first section 113*a* and the first end 115 of the further section 113*e* are aligned, possibly along the same line or positioned on the same plane.

The support structure 130 and/or the element having a substantially strip-like shape 113 may possibly have a connection section 113*f*, with substantially straight development and perpendicular to the first section 113*a* and the section 113*e*.

In this case, the high frequency area A is positioned, in such version, substantially at the area arranged between the third section 113*c* and the further section 113*e*.

In a version of the invention, non-limiting with respect to the present invention, the accessory 100 has a length D substantially corresponding to about 1.6-1.8 metres. The section 113*f* may be about 1.5-1.6 metres.

The diameter of the section 113*b* may be about 1 metre.

The radius of the section 113*c* is about 1 metre.

The section 113*e* is about 0.3-0.4 metres.

1The thickness of the element having a substantially strip-like shape is about 3 cm.

The inclination of the outer side of the element having a substantially strip-like shape ranges from 0 (at the second end of the section 113*a*), increases gradually along the section 113*b*, up to projecting outwardly with the lower edge thereof by 6 cm with respect to the upper edge thereof and maintains a projection of the lower edge equivalent to about 6 cm up to the first end 115 of the section 113*e*.

The distance between the peripheral edge of the sound board 103 and/or of the sound board 102 with respect to the inner vertical wall of the element having a substantially strip-like shape 113 may amount to about 2.5 cm or vary between 1.5 and 5 cm.

Figure 18:
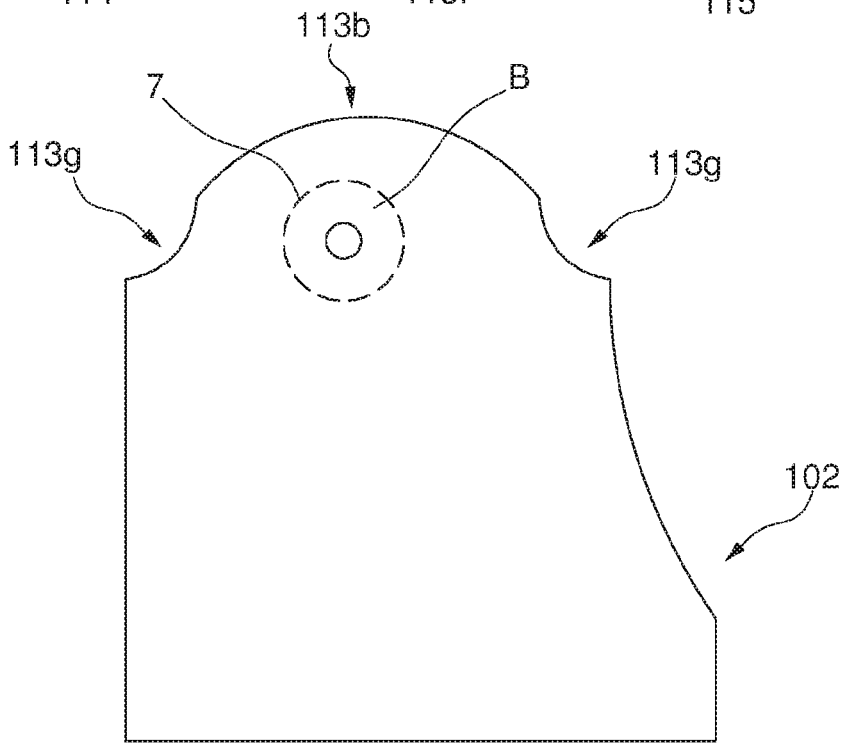
FIG. 18 is a plan schematic view of a lower component of the sound diffuser accessory of FIGS. 11 and 14-15.

The lower sound board 102, as observable in FIG. 18, has a substantially similar shape but, at the ends of the second section 113*b*, it has substantially circular-shaped cavities 113*g* with opposite concavity with respect to that of the second section 113*b*. Such cavities 113*g* correspond, in at least one version of the invention, to the area in which possible support legs or brackets 20 of the support structure 130 are applied.

In a version of the invention, the upper sound board 103 has a diameter, at the section 113*b*, equivalent to about 0.9 metres, a size at the section 113*e* equivalent to about 200-250 cm, a size at the section 113*f* equivalent to about 1.3-1.4 metres and a length D of about 1.4-1.5 metres.

The radius of the part at the section 113*c* is about 1 metre.

In a version of the invention, the lower sound board 102 has a diameter, at the section 113*b*, equivalent to about 0.8 metres, a size at the section 113*e* equivalent to about 200-250 cm, a size at the section 113*f* equivalent to about 1.0-1.1 metres and a length at the section 113*a* of about 0.8-0.9 metres. The radius of the cavities 113*g* is about 0.1-0.2 metres. The radius of the part at the section 113*c* is about 1.05 metres.

The segment subtended to the circumference arc of the sound board 102 at the section 113*b* is about 0.6-0.7 metres.

In a version of the invention, the support structure 130 further comprises spacer means 122.

In such version, the at least one step 132 may be considered a connection means between the support structure 130 and the sound board 102, 103, combined with the spacer means 122.

The connection means 16 described regarding the preceding embodiment can be present or absent as concerns this embodiment.

The connection and fixing between the support structure 130 and/or the element having a substantially strip-like shape 113 and/or the sound board 102, 103 can be made more secure for example by inserting special pins or screws or metal fasteners.

According to a version of the invention, one or two protrusions 21 can be coupled to the ends 14 and/or 15 of the support structure 3 and/or of the element having a substantially strip-like shape 13, through connection means 16 or through other suitable coupling and/or constraint means.

Such at least one protrusion 21 may be variously shaped so as to adapt to a possible digital and/or electronic piano associated to the accessory 1 or to a sound source in general, to as to confer a particular aesthetic aspect to the accessory.

Such protrusions 21, if present, may have the same longitudinal development that has the support structure 3 and/or the element having a substantially strip-like shape 13 or it may have a development substantially perpendicular thereto (for example as visible in FIG. 4).

The accessory 1, 100 and/or the support structure 3, 130 further comprises, as mentioned, spacer means 22, 122 that space the sound board 2, 102, 103 from the support structure 3, 130 and simultaneously constrain, possibly in a removable fashion, such two components to each other.

In a version of the invention, there are 4 to 16, preferably between 6 and 10 and even more in particular between 8 and 12 spacer elements 22, 122.

According to a non-limiting example, the upper sound board 103 or the sound board 2 are constrained to the support structure 3, 130 using 8 spacer elements 22, 122 or at 8 points where the spacer elements 22, 122 are positioned.

According to a non-limiting example, the lower board 102 is constrained to the support structure 130 using 8/10 spacer elements 122 or at 8/10 points where the spacer elements 122 are positioned.

The at least one sound board 2, 102, 103, in at least one version of the invention, is constrained to the support structure 3, 130 only at the spacer means 22, 122. The spacer means are spaced, from each other, by a section equivalent to at least 30 cm and having maximum dimension substantially equivalent to the length D or to the width d or to about half of such lengths or they can even be positioned at the corners or edges or at the points of change of direction of the various sections that form the support structure 3, 130 and/or the at least one sound board 2, 102, 103.

Such spacer means 22, 122 are shaped to form a pin or a parallelepiped with square or polygonal base and they have a height H2. The height H2 can be comprised between 20 and 100 mm.

Thus, the sound board 2, 102, 103 is at a distance H2 from the support structure 3, 130 or at least from the edge thereof facing in use towards the second surface 5 of the sound board.

Having just a few points of contact with the base structure 3, 130, i.e. the points of contact corresponding to the number and the position of the spacer means 22, 122, the sound board is free to vibrate and emit or diffuse sounds, without the support structure 3, 130 affecting or altering the operation thereof.

Between the spacer means 22, 122 and the sound board 2, 102, 103 there can be present damping means, for example rubber or rubber elements, so as to avoid the noise produced by the vibrations on the spacer means.

The spacer means 22, 122 are fixed to the sound board 2, 102, 103 using suitable fixing means and/or they are, possibly, at least partly housed in suitable seats obtained in the sound board 2, 102, 103.

For example, as illustrated in FIGS. 16A and 16B, the spacer means 122 are in contact with the support structure 130 and the non-exposed face or surface 5 respectively of the sound boards 102, 103 of the accessory 100.

At the outer surface 4 instead, there can be a sort of frame 160 which fully or partly follows the perimeter of the sound board 102, 103 and/or it can be present at the spacer means 122 only.

Such frame 160, for example made of hard wood or made of hard material and/or made of wood/material that is harder than that of the sound board 102, 103, makes the fixing of the spacer means 122 using suitable fixing means more secure.

Figure 8:
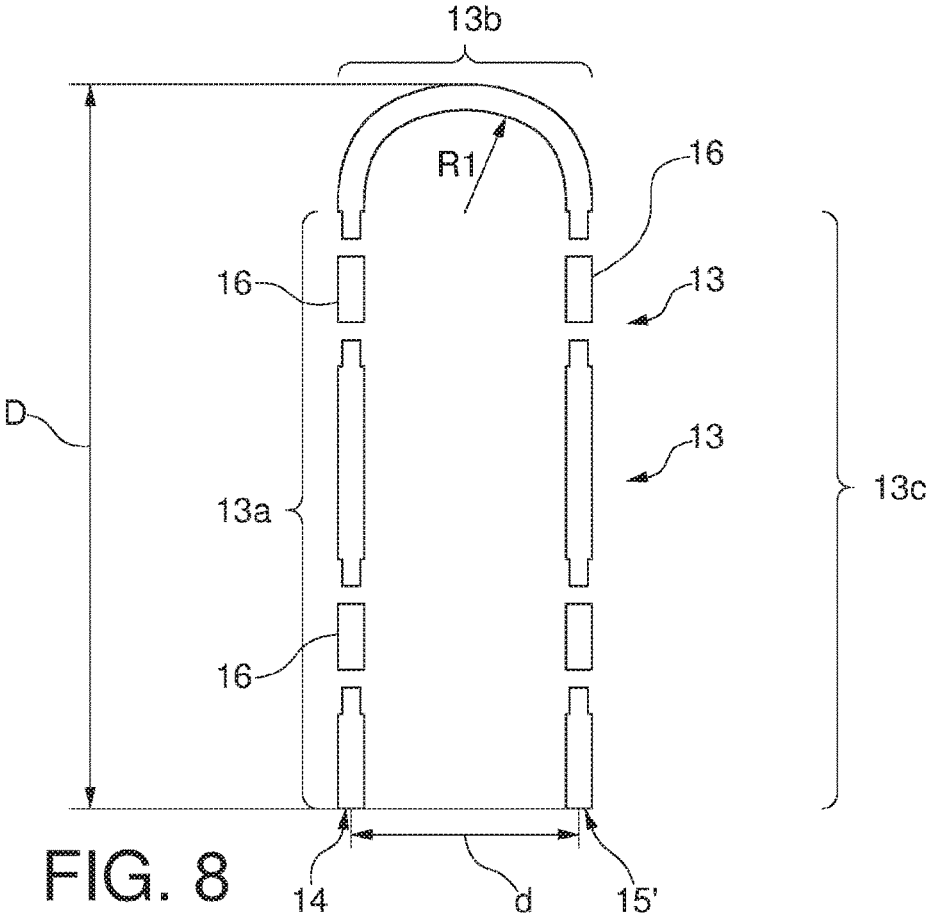
FIGS. 8 and 9 are plan schematic views of the support structure of the sound diffuser accessory according to the present invention, according to further versions.
Figure 9:
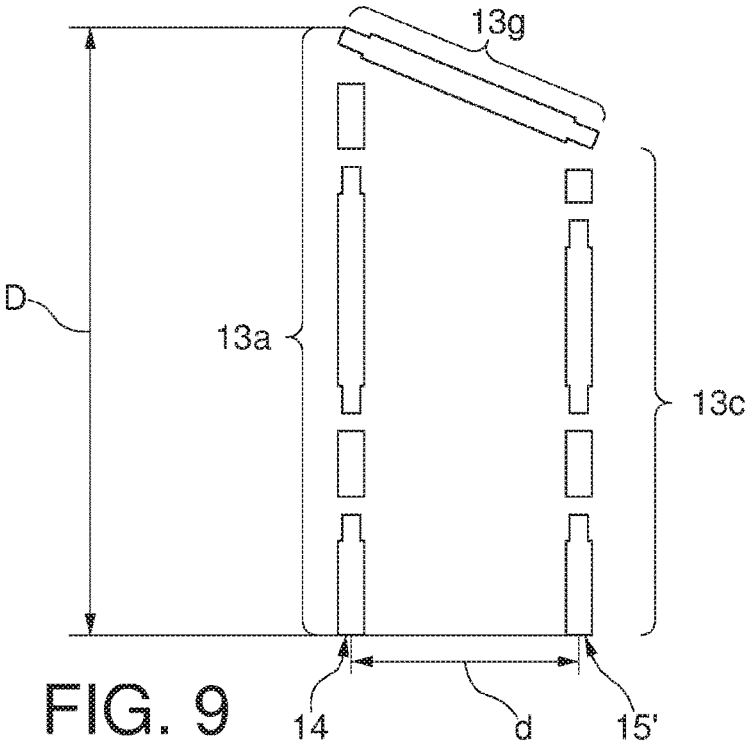
Figure 11:
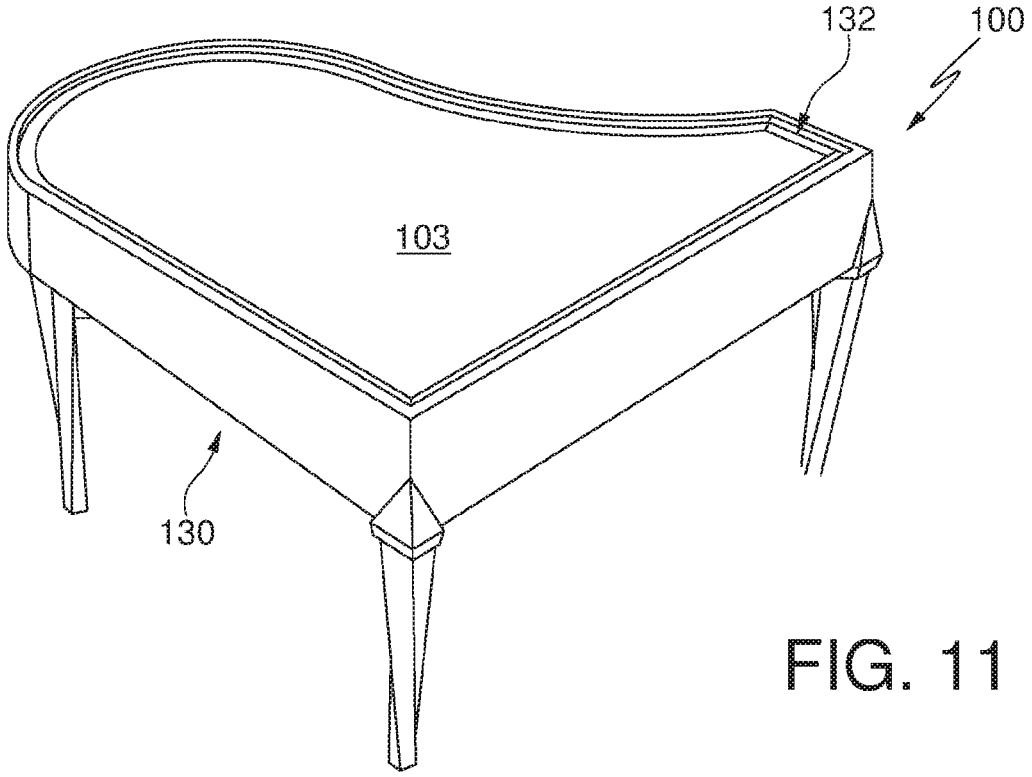
FIG. 11 is a perspective view from above of a sound diffuser accessory according to a version of the present invention.

As observable in FIGS. 8 and 9, which represent further exemplifying but non-limiting versions of the present invention, the support structure 3, and/or thus the sound board 2, may have plan configurations different from the ones described above, without departing from the scope of protection of the present invention. In such versions, only the shape actually varies whereas the functionality and method of connection remain the same described above.

This also applies to the support structure 130 and/or to the element with substantially strip-like development 113 of the accessory 100.

In FIG. 8, for example, the support structure 3 and/or the element having a substantially strip-like shape 13 has a first section 13*a* with substantially straight development, a second section 13*b* with substantially curved development with a first radius of curvature R1 and a third section 13*c* with substantially straight development.

The second section 13*b* has a substantially semi-circular configuration, as previously described. The first section 13*a* has a first end 14, opposite to the second end of the first section 13*a*, the latter end being connected or constrained to the second section 13*b*.

The third section 13*c* has a development that departs from the second section 13*b* and extends in the substantially parallel direction towards the first end 14 of the first section 13*a*. The third section 13*c* has a first end 15', opposite to the second end of the third section 13*c*, the latter end being connected or constrained to the second section 13*b*.

The end 15' corresponds to the end 15 described above.

The first end 14 of the first section 13*a* and the first end 15' of the third section 13*c* are aligned, possibly along the same line or positioned on the same plane. Also in this case, there may be present a sixth section or connection section 13*f* (for example visible in FIG. 1), with substantially straight development and perpendicular to the first section 13*a* and to the third section 13*c*.

In FIG. 9 instead, for example, the support structure 3 and/or the element having a substantially strip-like shape 13 has a first section 13*a* with substantially straight development, a joining section 13*g* with substantially inclined development with respect to the first section 13*a* and a third section 13*c* with substantially straight development.

In a version, the joining section 13*g* has an inclined development not with respect to the first section 13*a* but with respect to the third section 13*c*.

In a further version, the joining section 13*g* has an inclined development both with respect to the first section 13*a* and with respect to the third section 13*c*.

The first section 13*a* has a first end 14, opposite to the second end of the first section 13*a*, the latter end being connected or constrained to the joining section 13*g*.

The third section 13*c* has a development that departs from the joining section 13*g* and extends in the substantially parallel direction towards the first end 14 of the first section 13*a*. The third section 13*c* has a first end 15', opposite to the second end of the third section 13*c*, the latter end being connected or constrained to the connection section 13*g*.

The end 15' corresponds to the end 15 described above.

The first end 14 of the first section 13*a* and the first end 15' of the third section 13*c* are aligned, possibly along the same line or positioned on the same plane. Also in this case, there may be present a sixth section 13*f* (for example visible in FIG. 1), with substantially straight development and/or perpendicular to the first section 13*a* and to the third section 13*c*. In such versions, the sound board 2 is respectively oval or ellipsoidal or trapezium-shaped. Thus, the first surface 4 and the second surface 5 thereof are also oval or ellipsoidal or trapezium-shaped.

Still, the sound board 2 may also be triangular-shaped, rectangular-shaped, with chamfered edges, etcetera.

The connection means 16 are arranged at least between said sections 13*a*-13*g*, with variable number and position depending on the specific versions and depending on whether some sections are present or absent in the support structure 3.

Thus, the connection means 16 can be associated using the ends 18 of the components or parts that form the support structure 3 and/or using the ends 14, 15, 15' of the various sections 13*a*-13*g*.

In each section 13*a*-13*g* there can be respectively present a component or part of the support structure 3 or at least some of the sections 13*a*-13*g* can each comprise several components or parts of the support structure 3. In such case, the number of the connection means 16 will be such to connect and assemble the components or parts of the support structure together, so as to obtain the various sections 13*a*-13*g*.

The dimensions of the sound board 2, 102, 103 are important and substantially correspond, in at least one version of the invention, to the dimensions of the tail of an acoustic piano, even possibly to the dimensions of a concert grand piano.

In particular, considering the plan view illustrated in FIG. 10, the sound board 2 (and substantially the accessory 1) has a length D and a width d.

The length D may vary between 130 cm and 280 cm, preferably it is about 160-175 cm.

The width d may vary between 130 cm and 170 cm, for example it is preferably comprised between 150-160 cm or it is about 152 cm.

Even in the other embodiments of the sound board 2, for example illustrated in FIGS. 8 and 9, the length D and the width d of the board itself can be identified.

In the version illustrated in FIG. 4, in which the accessory 1 is applied on a wall, the length D can be considered as the height of the accessory.

Thus, the dimensions of the sound board 2 correspond to an area comprised between 2 and 4 $m^2$. In a version of the invention, the area of the sound board 2 can exceed 4 $m^2$.

However, it is clear that the weight of the accessory 1 according to the present invention is markedly lower than the weight of a music instrument, such as a piano for example, having the same plan overall dimension.

As mentioned previously, the sound board 2, 102, 103 has at least one recess or seat 7, arranged at a nodal point of the sound board 2, i.e. at a vibration node of the board (nodal point). Such at least one nodal point can be positioned in the central and/or peripheral area of the board 2. In the nodal point, the transfer of energy to the sound board 2, 102, 103 is better (greater efficiency of coupling/transmission vibrational-energy).

The at least one recess or seat 7 is suitable to house at least one transducer (illustrated by way of example only in FIG. 20 with reference T) of the electromechanical and/or piezoelectric and/or magnetodynamic and/or magnetostrictive type. Such at least one transducer, in turn associated to at least one sound source, is suitable to impart the mechanic vibrations to the sound board 2, 102, 103, so that the latter reproduces and/or diffuses the sound or the electro-acoustic signal deriving from the sound source.

In a version of the invention, in the bass sounds area B a transducer is positioned, for example a low frequencies transducer; in the medium sounds area M one or two transducers are present, for example medium frequencies transducers; lastly, in the treble sounds area A one or more transducers are present, for example high frequencies transducers. In the lower board 102 there may be the bass sounds transducer only.

From such sound source, an audio signal, for example optimised, is emitted, which signal is transmitted to the at least one transducer applied on the sound board 2, 102, 103 according to the present invention. The at least one transducer is vibrated by the audio signal deriving from the sound source and, being integrally joined to the sound board 2, 102, 103, it transmits vibrations to the latter.

The vibrating sound board enables the user to feel the sound, or rather the range of sounds, deriving from the sound source and from the sound signal transmitted by it.

In a version of the present invention, such at least one transducer may be of the coil and/or of the piezoceramic type.

In a version, three transducers, for example two of the coil type and one of the piezoceramic type, are associated to the sound board 2, 102, 103.

The coil transducers comprise a moving coil and a permanent or static magnet.

In some known devices, for example associated to acoustic pianos equipped with strings, in order to generate energy that is sufficient to vibrate the respective sound boards, which are compressed by the strings and are thus subjected to a tension that even reaches 400 kg, the magnets must be very powerful and thus heavy. This is the reason why they are not fixed to the sound board because they would otherwise interfere with the operation thereof and would add extra weight to the yet existent weight.

As clarified in the present description, this instead is not necessary as concerns the accessory 1, 100, in which on the contrary the at least one transducer is directly associated to the sound board 2.

According to the present invention, the sound board 2, 102, 103 of the diffuser accessory 1, 100 is—as mentioned—free, i.e. it is not connected to the strings for example of an acoustic piano, and thus has a weight and thickness that are much lower than those of conventional sound boards.

Thus, the magnets required to vibrate it are much lighter and with limited power (watts) with low consumption and thus, even though directly connected to the sound board 2, 102, 103, they do not interfere with the operation thereof. On the contrary, being directly connected and integrally joined thereto, the energy transmission efficiency is increased obtaining a better sound/acoustic result (enhanced acoustic efficiency).

According to a version, the at least one transducer comprises a piezoceramic transducer, for example a bimorph piezoceramic bender. Such transducer, for example, through a bimorph piezoceramic disc with an about 50 mm-diameter, is capable of producing mechanical displacements substantially greater than 200 microns in a frequency band comprised between about 60 and about 16000 Hz, with a blocking force (the maximum force that can be generated by the single actuator, i.e. the locking force required to reduce maximum displacement to zero) comprised between about 6 N and about 20 N and a supply voltage comprised between about 70 V and about 100 V.

An advantage of the present invention lies in that the transducers are directly associated to the sound board 2, 102, 103 and not to the support structure 3, 130 thereof. This aspect represents a major advantage for the diffusion of the sound through the accessory 1 according to the present invention, in that the amount of transmitted energy is the higher the greater transducers are integrally joined to the sound board 2, 102, 103. Thus, the sound diffuser accessory 1, 100 according to the present invention is much more efficient with respect to the devices of the known type. The acoustic advantage obtained from the use of the sound board 2, 102, 103 vibrated by the at least one transducer (or by more than one transducer) directly coupled to the sound board, lies in obtaining a "natural" sound (rich with natural harmonics) that the wood, in particular fir wood for example, expresses, like a true instrument, while the devices of the known type (conventional speakers) with membrane/cone made of synthetic material, have to forcibly imitate/reproduce natural sounds with natural harmonics, given that they are not intrinsically found in the material of the membrane itself (which is usually polyamide).

Furthermore, due to the fact that the at least one transducer and the sound board 2, 102, 103 are integrally joined and/or are at contact, the sound quality reaches levels that can never be attained by speakers of the known type and that reach the levels of acoustic music instruments of the conventional type, such as grand pianos.

In a version of the invention, the transducers are connected to the sound board through gluing means, for example a two-component glue.

The at least one transducer is connected, by means of a cable, to an audio conversion circuit, which is in turn connected to the audio output of a sound source. The conversion circuit is preferably integrated in the accessory 1, 100 and it is suitable to translate a sound information or a sound or an electro-acoustic signal deriving from the source into mechanical pulses and into ensuing vibrations of the sound board 2, 102, 103.

In particular, in a possible version, the circuit comprises a conversion and adaptation stage to the mains voltage, preferably obtained in switching technology, with very low voltage, a fuse-protected element, an ON switch and a cable for connecting to the mains power supply.

As concerns filtering and stabilising the signal, a stage comprising a Graetz bridge rectifier, for levelling and stabilising dual voltage, is used.

The conversion circuit further comprises a stage for adapting and equalising the input sound signal, comprising an active input adapter network and a DSP multi-band digital integrated circuit with regulation of every band through a special software connected to a PC for example.

Furthermore, there is provided for a solid state low frequency amplification stage, preferably made up of a class D digital switching circuit and with MOSFET final transistors, a muting and protection digital circuit.

Lastly, the conversion circuit is preferably completed with a muting or standby function control logic, having a CMOS and LED circuit indicating the standby status. Such sound source may comprise an electric or electronic piano, a hybrid piano, a digital piano, an electric or electronic keyboard, a CD player, a smartphone, a tablet or a computer, or a sound source in general.

As indicated, the at least one transducer is suitable to transfer energy to the sound board 2, 102, 103 in form of vibrations, translating into mechanical pulses the electrical signals deriving from the sound source.

The fact that the sound board 2, 102, 103 has areas with variable thickness S, S', S" enables optimising and/or harmonising the transfer of energy into the board itself.

The thicknesses S', S", S vary between 3.5 mm and 8.0 mm A lower thickness implies an elevation of low frequency tones, while a greater thickness elevates the high frequency tones.

The identification of areas with variable thickness of the sound board occurs through conventional music instruments construction techniques.

Each slat or listel that forms the sound board 2, 102, 103 may for example have a width of 7-8 cm, a thickness of 7-9 mm and a length of about 220 cm in the direction of the fibre.

The accessory according to the present invention may further comprise secondary ribs, suitable to transfer vibrational energy from particularly rich acoustic areas of the board to poorer acoustic areas, in terms of vibration intensity in an acoustic frequency band.

Figure 3:
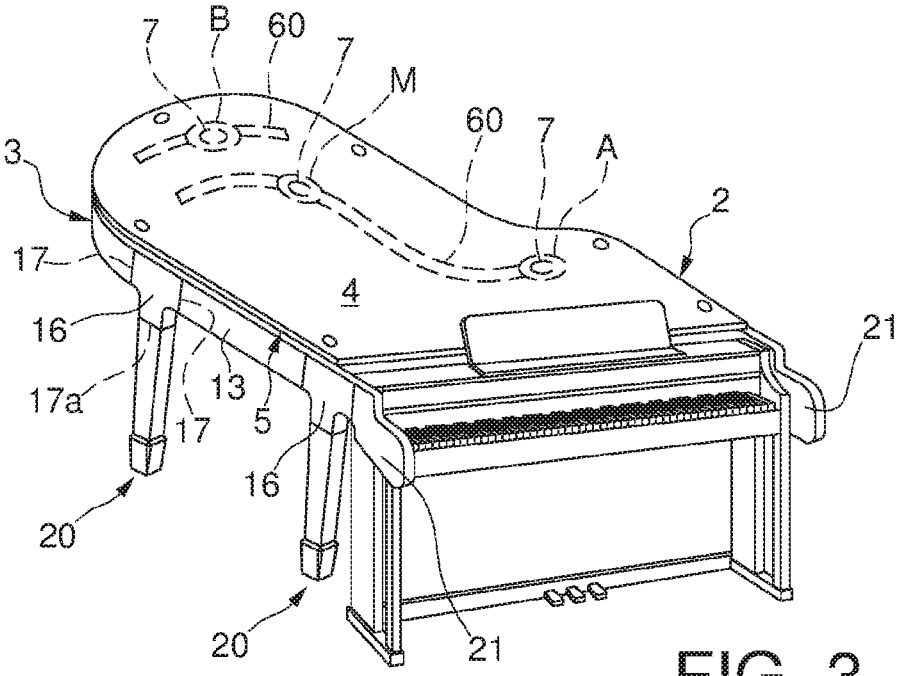
FIG. 3 is a front perspective view of a particular application of the sound diffuser accessory of FIG. 1.

In a further version, the accessory 1 may comprise at least one reinforcement listel 60 (indicated with a dashed line for example in FIGS. 3 and 10). Such at least one reinforcement listel 60 replicates the position in which, in conventional acoustic grand pianos, there is a bridge. Such at least one reinforcement listel 60 has a substantially semi-curved development and it is applied on the sound board 2, at the exposed surface 4 thereof.

The at least one reinforcement listel 60 may comprise one or more listels, possibly made of wood, with very thin thickness; as mentioned above, they replicate or they are suitable to delimit or mark the position of these elements referred to as "bridges" that are present in the acoustic piano and on which the strings rest. These reinforcement elements or listels 60 also serve as a further "thickness" for the sound board 2 so as to receive any screws for fixing the at least one transducer (in particular at the points or areas "B", "M" and "A", respectively of the bass sounds, of the medium sounds and of the treble sounds) which would otherwise if fixed only in the thickness of the sound board 2 (which is 4-6 mm in at least one version) be precarious (specifically due to the low thickness of the material).

This component can be present for the accessory 100 too.

As a matter of fact, in a version, the at least one reinforcement listel is made of hard wood (beech, oak or maple tree). As previously mentioned, a possible use of the present accessory 1 according to the present invention could be that of being associated to a digital piano, such as for example an electrical or electronic keyboard.

Digital pianos usually have speakers arranged at the area beneath the keyboard. Thus, the musician using the digital piano cannot enjoy the roundness of the emitted sound, in that he/she hears it coming from beneath, without the sound itself neither reaching its full roundness nor the space surrounding the piano in a uniform manner.

On the contrary, upon connecting the accessory 1, 100 to the digital piano or to the electric keyboard, it firstly takes (at least in a version of the invention) the shape of a grand piano and, from the sound point of view, it is transmitted to the sound board 2, 102, 103 producing a high sound diffusion quality, in a wide range of frequencies and reaching the entire space surrounding the sound board.

Thus, the type of sound transmitted by the sound board 2, 102, 103 according to the present invention is absolutely natural and corresponds to the sound, the timbre and the melody produced by conventional or acoustic music instruments. Thus, the accessory 1 according to the present invention enables creating the feeling of enjoying live performance, and not a diffusion of sounds deriving from a sound source, for example of the electronic type.

In particular, the sound board or the accessory according to the present invention is a true music instrument, which resounds thanks to the vibrations of the sound board.

The range of frequencies that can be diffused by the present invention ranges from a minimum of about 40 Hertz up to a maximum of about 19500 Hertz. As observable, such frequency range, which corresponds to that of true music instruments, such as for example a grand piano, is absolutely higher than that of speakers of the known type and it also emits a natural and full sound (rich with natural harmonics) like the one emitted live.

The fact that the sound board 2, 102, 103 is made of wood enables obtaining diffused sounds that are pure, brilliant, natural, deep, with natural harmonic richness, despite the sound source being of the electrical or electronic type, creating the feeling of enjoying conventional music instruments live, something that is impossible to obtain using speakers of the conventional type.

A further advantage of the accessory according to the present invention lies in constituting a furnishing object, such as for example a piece of furniture, or some sort of "music instrument" or else a diffuser of sounds deriving from a sound source, that is aesthetically pleasant. Thus, the environment in which it is installed will acquire design and/or aesthetic value.

At the same time, the accessory according to the present invention is inexpensive, light, easy to transport as well as easy to assemble/disassemble, and possibly modular.

In at least one version of the invention, in fact, the assembly (and on the contrary the ensuing disassembly) of the accessory according to the present invention occurs according to one or more of the following steps: arranging a base structure 3 made up of one or more components or parts and connection means 16, provided with at least one opening 17, inserting at least one end 18, 14, 15, 15' of the components or parts of the support structure 3 into the at least one opening 17 of the connection means, so as to assemble the pre-established configuration of the support structure 3, provide one or more spacer means 22, fix the spacer means 22 between the support structure 3 and the sound board 2, so that the sound board 2 is spaced by a distance H2 from the support structure 3.

Providing at least one support leg or bracket 20 and inserting an end 20*a* thereof into an end 17*a* of the connection means 16 or fixing the support structure 3 to a wall.

Fixing the at least one protrusion 21 to at least one end 17, 17*a* of the connection means 16.

Connecting at least one sound source to the accessory 1 through at least one transducer connected or associated to the sound board 2, so that the sound board 2 can be vibrated depending on the sound signal emitted by the sound source so that the accessory 1 can diffuse the relative sounds or melodies or music.

In plant view in at least one version of the present invention, the sound board 2 and the support structure 3 have the same base configuration. In particular, the support structure 3 has in plant view the same shape as the peripheral edge of the sound board 2.

The present invention further refers to a kit comprising the accessory 1, 100 according to the present invention and at least one sound source, of the type described above.

Such kit enables reproducing sounds and music faithfully, just like a true music instrument.

The sound board 2, 102, 103 in the present invention, is—as mentioned—"free", in the sense that it is not associated to other elements required for sound diffusion (such as for example the mechanical elements present in acoustic pianos), and it is connected or constrained to the support structure 3 only.

Thus, the transducers associated thereto are also light in weight, given that the energy they are required to transmit is just the amount required to vibrate the sound board 2, 102, 103 not constrained—on the entire edge—to the support structure 3, 130 thereof as it occurs in an acoustic piano for example, in that the sound board 2, 102, 103 is suspended with respect to the support structure 3, 130 and constrained to the latter at the spacer means 22, 122 only. In a version of the invention, the spacer means 22, 122 are five or six.

Thus, even though the transducers are directly connected to the sound board 2, 102, 103, being light in weight they do not interfere with the possibility of vibrating the sound board itself and thus they do not negatively affect the quality and efficiency of the transmitted or diffused sound.

Obviously, during assembly it is always possible to perfect the response of the sound board 2, 102, 103 by modifying the thicknesses and/or shaping the at least one rib, so as to obtain the desired quality and efficiency for the diffusion and transfer of the energy and/or reducing possible interference to the minimum. To this end, it is possible to apply to the ribs some mechanical tensioners constituted by metal tensioning elements fixed to the ribs at the opposite ends and provided with an adjustment/tensioning system on a threaded element (for example screw elements).

In a version of the invention, the accessory 1, 100 may comprise a housing for an amplifier, not illustrated in the drawings attached herein.

In at least one version of the invention, such housing is positioned beneath the sound board 2, 103 and/or the support structure 3, 130, so as not to be directly visible from the environment in which such accessory 1 is positioned.

Such housing, will however be accessible for the user, who will thus be able to reach the controls and/or connections required to adjust the operation thereof and/or connect it to the accessory itself and/or with the sound source and/or with a possible further device present.

The possible amplifiers and/or the electronics described above can be inserted, for example by means of a front control element, in the structure of the accessory 1, 100 or, in an alternative version, they can be separate or external with respect to the same.

Lastly, there can be provided for a lid for closing the accessory 1, 100, whose shape substantially corresponds to that of the accessory and/or the support structure 3, 130.

Such closing lid can be constrained or hinged, for example by means of at least one hinge, at one side of the accessory 1, 100, for example at a section 13*a*, 113*a* thereof. The invention thus conceived is susceptible to numerous modifications and variants all falling within the inventive concept.

The characteristics outlined regarding a version or embodiment can be combined with the characteristics of another version or embodiment, without departing from the scope of protection of the present invention.

In addition, all details can be replaced by other technically equivalent elements. Basically, the materials used as well as the shapes and contingent dimensions, may vary according to the needs without departing from the scope of protection of the claims that follow.

The invention claimed is:

1. A sound diffuser accessory suitable to be associated with a sound source, and to diffuse sounds or sound signals coming from said sound source, wherein said accessory comprises at least one sound board and a support structure for said sound board, wherein said at least one sound board comprises a board or panel having a flat or slightly curved shape and comprising a first external or exposed visible surface, a second surface, opposite said first surface and a thickness (S), wherein said at least one sound board comprises at least one rib positioned at said second surface of said sound board, wherein said at least one rib has a straight or slightly curvilinear shape, wherein said at least one sound board is suitable to comprise or be connected with at least one transducer of electromechanical and/or piezoelectric and/or piezoceramic and/or magnetodynamic and/or magnetostrictive type, wherein said support structure comprises at least one element having a substantially strip-like shape and spacer means having a height (H2), suitable to constrain said at least one sound board and said support structure, in a removable way, and space said at least one sound board and said support structure so that said at least one sound board is at a distance substantially equivalent to the distance (H2) from said support structure or from an edge of said support structure facing towards said surface of said at least one sound board.

2. The accessory according to claim 1, wherein said at least one sound board comprises at least one first and one second sound board, wherein said first sound board is arranged in use above said second sound board, the second sound board being arranged in use beneath said first sound board and/or wherein said second sound board and said first sound board are mechanically connected by a connector element, which connects bass transducers (B) respectively positioned on the surface of said sound boards, and/or comprising a connector element shaped to form a pin or a cylinder or a parallelepiped or any other suitable shape.

3. The accessory according to claim 1, wherein said at least one sound board, through said spacer means is suspended or raised and/or elevated with respect to said support structure and/or to said edge of said support structure.

4. The accessory according to claim 1, wherein said support structure and/or said at least one element having a substantially strip-like shape has a shape substantially corresponding to the shape of at least part of the perimeter edge of said sound board or has an annular shape or an open annular shape.

5. The accessory according to claim 1, wherein said support structure and/or said element having a substantially strip-like shape is constituted by a single listel shaped in a manner substantially corresponding to at least part of the perimeter edge of said sound board or by one or more parts or components that can be assembled to each other so as to substantially correspond to at least part of the perimeter edge of said sound board.

6. The accessory according to claim 1, wherein said sound board is substantially grand piano shaped and/or wherein said support structure and/or said element having a substantially strip-like shape comprises a first section with substantially straight shape, a second section with substantially curved shape with a first radius of curvature (R1), a third section being substantially straight, a fourth section being substantially S-shaped and a fifth substantially straight section, wherein said third section has a shape departing from the second section and extending in a substantially parallel direction with respect to the first section and said fourth section moves apart from the first section or wherein said element having a substantially strip-like shape comprises a first section with substantially straight shape, a second section with substantially curved shape with a first radius of curvature (R1) and/or a concavity facing towards a centre of the area that is subtended to the support structure, a third section with substantially curved shape, with concavity substantially opposite to that of said second section and a further substantially straight section, wherein said third section has a shape departing from the second section moving apart from the first section.

7. The accessory according to claim 1, wherein said sound board and/or said surfaces thereof have a configuration that is oval or ellipsoidal or trapezium, or triangular, or rectangular-shaped, with chamfered edges, and/or wherein said support structure and/or said element having a substantially strip-like shape comprises a first section with substantially straight shape, a second section with substantially curved shape with a first radius of curvature (R1) and a third section with substantially straight shape in a direction substantially parallel to that of said first section or comprises a first section with substantially straight shape, a joining section and a third section with substantially straight shape, wherein said joining section has a substantially inclined shape with respect to the first section and/or the third section.

8. The accessory according to claim 1, wherein said support structure and/or said element having a substantially strip-like shape comprises a sixth section or connection section, having a substantially straight shape and being perpendicular to the first section and to the fifth section or to the first section and/or to the third section.

9. The accessory according to claim 1, wherein said support structure and/or said element having a substantially strip-like shape and/or said one or more parts or components thereof have a conformation of parallelepiped with rectangular base and/or have faces having larger surface positioned perpendicular to said sound board and having the height (H1, H1*a*, H1*b*) and/or have a thickness (W), substantially equal for the entire extension of said support structure and/or of said element having a substantially strip-like shape or substantially equal at least for the first section and/or for the sixth section or connection section.

10. The accessory according to claim 1, wherein said support structure comprises connection means, suitable to connect said one or more components or parts of said support structure and/or of said element having a substantially strip-like shape and/or wherein said support structure comprises connection means suitable to connect said support structure and said sound board.

11. The accessory according to claim 10, wherein said connection means comprise a central body provided with at least one seat, suitable to house at least one end of at least one component or part of said support structure and/or of said element having a substantially strip-like shape, wherein said connection means comprise pins or screws or metal fasteners and/or wherein said end comprises at least one element and/or a relative seat for said pins or screws or metal fasteners.

12. The accessory according to claim 8, wherein said connection means comprise a T-shaped central body, wherein the sections of the T-shaped element comprise two seats and a further or third seat, wherein said two seats are suitable to house and/or be engaged with two ends while said further or third seat is suitable to house and/or be engaged with an end of at least one support leg or bracket of the support structure.

13. The accessory according to claim 1, wherein said connection means comprise said spacer means.

14. The accessory according to claim 1, wherein said spacer means are shaped to form a pin or parallelepiped with square or polygonal base and/or wherein said spacer means are constrained to said edge of said support structure facing towards said surface of said sound board.

15. The accessory according to claim 1, wherein the thickness (S) of said sound board is comprised between 3.5 mm and 8.0 mm or between 4 mm and 6 mm and/or wherein said thickness (S) comprises a greater thickness (S') in an area of said sound board capable of diffusing treble sounds (A), and a minimum thickness (S") in an area of said sound board capable of diffusing bass sounds (B), and/or wherein said thickness (S) is degrading from areas of said sound board with thickness (S') towards areas of said sound board with thickness (S") and/or wherein said sound board comprises areas with variable thickness (S, S', S") and/or wherein said second sound board has only one area with thickness S", corresponding to the bass sounds or bass frequencies area (B).

16. The accessory according to claim 1, wherein said at least one rib is positioned at said second surface and/or wherein said at least one rib is arranged to be substantially transversal or inclined with respect to a long side or a larger side or to a long diagonal or to a larger diagonal of said sound board.

17. The accessory according to claim 1, wherein said sound board comprises one or more housing recesses or seats, suitable to house said at least one transducer, wherein said one or more housing recesses or seats are provided in the second surface of said sound board, and/or wherein said sound board comprises and/or is integrally joined with said at least one transducer or with two transducers of a coil type and with a transducer of a piezoceramic type.

18. The accessory according to claim 1, wherein said at least one sound board-and/or said at least one rib and/or said support structure and/or said element having a substantially strip-like shape is made of wood, including fir wood and/or wood usually used for making music instruments and/or fir wood.

19. The accessory according to claim 1, wherein said element having a substantially strip-like shape is inclined, in at least one portion thereof or at least in the outer side thereof, with respect to a plane on which said sound board lies by an acute inclination angle at a rear part of said accessory and/or by an inclination angle closer to 90° at least one larger side of said accessory and/or wherein said element having a substantially strip-like shape comprises an inner wall, faced in use towards said sound board perpendicular to a plane on which said second sound board lies.

20. The accessory according to claim 1, wherein said support structure comprises at least one step, wherein said step comprises a protrusion which projects from an inner wall of said element having a substantially strip-like shape in a manner substantially coplanar with said at least one sound board, wherein said at least one step serves as a support and/or sustaining element for each sound board.

21. The accessory according to claim 20, wherein said edge is present in said at least one step.

22. The accessory according to claim 21, comprising a first step positioned at the in use inner upper wall of the element having a substantially strip-like shape, wherein said edge forms an upper face of said first step, to which there is connected at least one spacer means through a first end, wherein at a second end of said spacer means there is connected said sound board, which is thus in a raised position with respect to the first step and/or comprising a second step positioned at the in use inner lower wall of the element having a substantially strip-like shape, wherein said edge forms a lower face of said second step, to which there is connected at least one spacer means through a first end, wherein at a second end of said spacer means there is connected said second sound board, which is thus in a suspended position with respect to the second step.

23. The accessory according to claim 1, comprising a gasket arranged at the angle between the first step and/or the second step and a support structure, at contact with the spacer means and/or with the surface of said sound board.

24. A kit for generating and/or diffusing sounds comprising an accessory according to claim 1, one or more transducers connected and/or integrally joined with at least one sound board and a sound source, connected to said one or more transducers, wherein said accessory is suitable to be vibrated by said at least one transducer and diffuse sounds deriving from said sound source and transmitted through said at least one transducer.

25. The kit according to claim 24, wherein said sound source comprises an electric or electronic or digital musical device or instrument, and electric or electronic piano, a hybrid piano, a digital piano, an electric or electronic keyboard, a CD player, a smartphone, a tablet or a computer, or a sound source in general.

26. The kit according to claim 24, wherein said at least one transducer is connected, through a cable, to an audio conversion circuit, which is in turn connected to the audio output of a sound source, wherein said conversion circuit is suitable to convert sound information or a sound or an electro-acoustic signal deriving from said sound source into mechanical pulses and into ensuing vibrations of the sound board.

* * * * *